US007399199B2

(12) United States Patent
Symons

(10) Patent No.: US 7,399,199 B2
(45) **Date of Patent: *Jul. 15, 2008**

(54) CABLE MANAGEMENT DEVICE

(75) Inventor: Dominic Symons, Pasadena, CA (US)

(73) Assignee: Blue Lounge Design, LLC, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/489,342

(22) Filed: Jul. 17, 2006

(65) Prior Publication Data

US 2007/0020993 A1 Jan. 25, 2007

Related U.S. Application Data

(63) Continuation-in-part of application No. 11/038,686, filed on Jan. 19, 2005, now Pat. No. 7,077,693, and a continuation-in-part of application No. 29/245,939, filed on Dec. 31, 2005, now Pat. No. Des. 556,019.

(51) Int. Cl.
*H01R 13/72* (2006.01)

(52) U.S. Cl. ..... 439/501; 439/242

(58) Field of Classification Search ..... 439/242, 439/501; 191/12.4
See application file for complete search history.

(56) References Cited

U.S. PATENT DOCUMENTS

| | | | | |
|---|---|---|---|---|
| 3,773,987 | A * | 11/1973 | Davis et al. | 191/12.4 |
| 4,150,798 | A * | 4/1979 | Aragon | 242/388.1 |
| 5,071,367 | A * | 12/1991 | Luu | 439/501 |
| 6,234,418 | B1 * | 5/2001 | Donaldson | 242/402 |
| 6,966,791 | B1 * | 11/2005 | Farr | 439/367 |
| 2002/0131749 | A1 * | 9/2002 | Swenson et al. | 385/135 |

* cited by examiner

*Primary Examiner*—Thanh-Tam T Le
(74) *Attorney, Agent, or Firm*—Law Office of David Hong

(57) ABSTRACT

A cable management device, which comprises a body having an axis and at least one planar flange and at least one cable retainer; this apparatus allows for removable attachment of a cable during axial winding in a single plane, which results in uniform and neat storage of cable or cord.

5 Claims, 27 Drawing Sheets

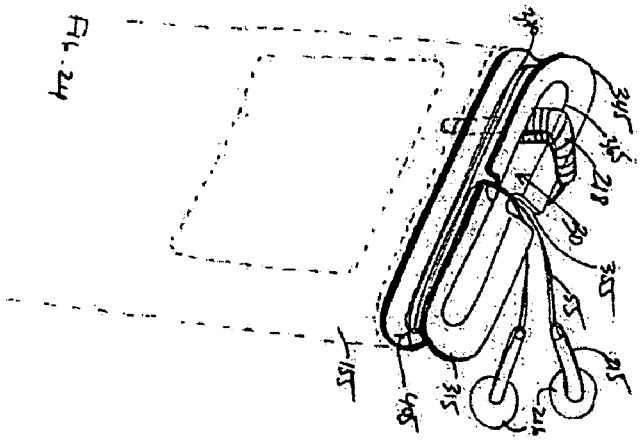
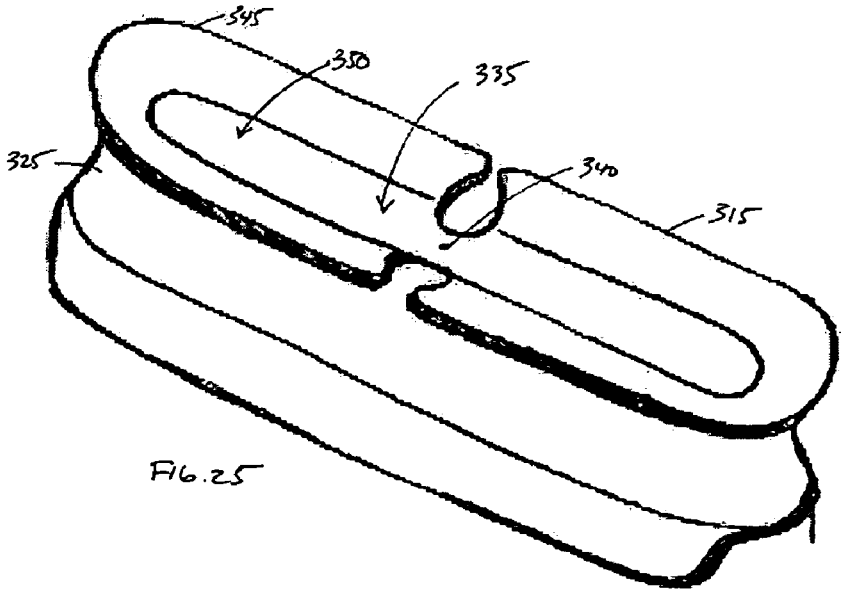
FIG. 25

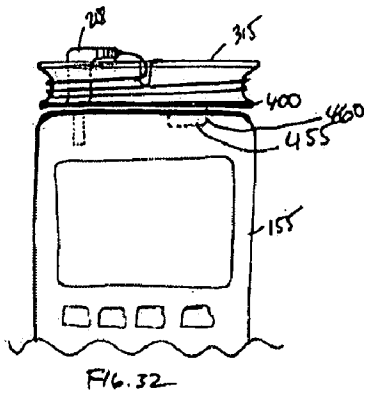
FIG. 30
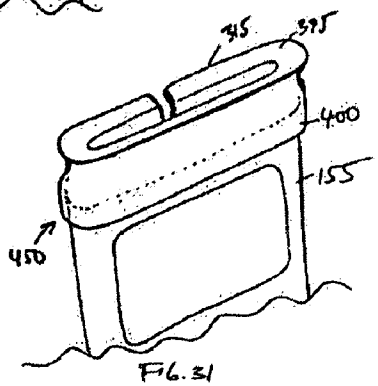
FIG. 31
FIG. 32
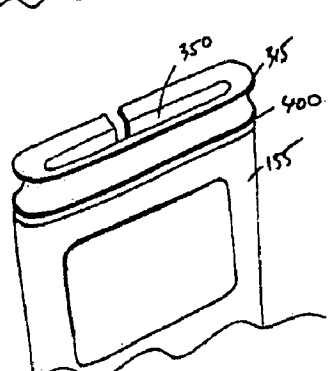
FIG. 33

CABLE MANAGEMENT DEVICE

This application is a continuation in part application of U.S. Ser. No. 11/038,686, filed Jan. 19, 2005, which issued into U.S. Pat. No. 7,077,693 on Jul. 18, 2006, and U.S. Design patent application Ser. No. 29/245,939, which was filed on Dec. 31, 2005 now U.S. Pat. No. D,556,019. This application also incorporates by reference the previous applications in their entirety.

BACKGROUND

1. Field of the Invention

This invention relates to cable and cord management devices.

2. Description of Related Art

Since the advent of electricity and the telephone, there has been the need to store and to manage loose and free electrical cables and insulated wires. These non-tethered and loose cords create clutter, confusion, and even safety hazards. With the advances in computers and electronic devices, including but not limited to Compact Disc (CD), MP3, cassette, radio and television receivers, Global Positioning Sensor (GPS), cellular and satellite telephones, and Portable Digital Assistant (PDA) devices, there has been a greater need to manage power and data cables. Any person, who looks behind their desktop computer, understands the dilemma of a multitude of unorganized cords and cables.

Even with the advent of wireless communication technology, there still is a need to connect the device to a power source. Currently, most electronic devices have a standard six-foot power or attachment cable, which are not retractable. Most cables are packaged with plastic ties or rubber bands to tie up the cable, but these devices are ineffective because the cords and cables end up being wound up in a tangled and unorganized manner, which can inevitably lead to tangled and damaged cords. Also, these devices do not allow for a quick and an easy length or position adjustment.

Many of these devices are bulky, conspicuous, obtrusive, and not readily portable. Many companies and designers go through a tremendous amount of effort to produce an elegant and beautiful device, and providing an accessory to gracefully and inconspicuously manage the cables and cords of these devices is required.

To address these problems, the inventor presents a suite of cable management devices that employ "Ultra-Thin Cable Management," which allows for neatly and uniformly storing and wrapping a cable in such a manner to prevent tangling and damaging of the cable. This invention allows for easy adjustment of the length of the cable, removal and unwinding of the cable, and placement of the apparatus on or near the electronic or computing device. This invention provides for multiple placement options including associating the cable management device directly with the electronic device or to furniture, tables, chair, desks, and the workspace.

From the preceding descriptions, it is apparent that the devices currently being used have significant disadvantages. Thus, important aspects of the technology used in the field of invention remain amenable to useful refinement.

SUMMARY OF THE INVENTION

The purpose of the present invention is to provide a simple and effective cable and cord management device, which can be universally applied to electronic devices with a cord or cable and can be removably secured and attached to a desk, a table, an electronic device, or computer.

Another purpose of the present invention is to allow a user to wrap the cable or cord in a single plane and around an axis of the body in order to prevent tangling, multiple plane overlapping and damage to the cable.

Other purposes of the present invention are: to provide a cable management apparatus to manage multiple cords, including stacking and combining of the apparatus; to provide a structure that allows for management of a loose cord or cable to neatly blend in with and to accessorize the underlying electronic device; and to provide a cable management structure that allows for branding and advertising of a product or service.

This invention provides an apparatus for managing a cable comprising: a body having an axis and a center and a first end and a second end; the first end has a first planar flange; the second end has a second planar flange; the first and second planar flanges are in a parallel orientation to one another and are oriented substantially perpendicular to the axis of the body and define a first cable retaining distance, which is oriented along the axis; the first planar flange has at least one channel, which extends approximately from the center of the body to a peripheral edge of the first planar flange and at least one first planar flange surface, which has at least one first cable retainer near the peripheral edge of the first planar flange; the second planar flange has at least one second planar flange surface, which has at least one second cable retainer at a peripheral edge of the second planar flange; the at least one first and second cable retainers are oriented such that said retainers face one another and define a second cable retaining distance, which is along the axis of the body and is less than the first cable retaining distance; the cable can be removably secured between the first and second cable retainers; the at least one first and second cable retainers allow axial winding of the cable around the body and in a single winding plane and beyond the peripheral edges of the first and the second flanges, whereby the cable can be placed through the channel, wrapped around the axis of the body in the single winding plane and in a substantially uniform manner, and held into place by the at least first and second flexible cable retainers.

The apparatus further has an attachment device with a first attachment end and a second attachment end; the first attachment end removably engages and interacts with the center of the body; and the second attachment end engages a separate surface, whereby the apparatus with the attachment device can be removably attached to the separate surface.

The first attachment end can removably engage the center of the body in a male/female mating connection; the second attachment end can have an adhesive surface and a suction cup surface.

The apparatus can have a hollow body center, and the first attachment end can pass substantially through the body. The first and second planar flanges can be square, rectangular, and irregular shaped. The apparatus can be comprised from plastic, alloy, metal, aluminum, and carbon fiber materials.

The apparatus can further have a clip, which is integrally molded to the first planar flange; the clip can have a clip channel, which mimics the position and orientation of the channel of the first planar flange, and a clip peripheral edge, which mimics the peripheral edge of the first planar flange.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

BRIEF DESCRIPTION OF THE DRAWINGS

FIG. 20 is an exploded view showing the interaction of engaging the body center to the male attachment device;

FIG. 21 shows the completed attachment of the apparatus and the interaction of neatly managing a cable for an electronic device;

FIG. 23 shows the versatility of this invention to manage cables.

FIG. 24 shows another embodiment of the invention detachably mounted to an electronic device to enable management of wires of some headphones.

FIGS. 25 and 26 show views of other embodiments of the invention.

FIGS. 30 and 31 show views of other embodiments of the invention: the sleeve or lip of the second flange overlapping one end of an electronic device.

FIG. 32 shows a view of another embodiment of the invention, which shows the second flange adjacent to one end of the electronic device; note also the insertion of the headphone jack through the body and also an additional stabilizing prong mating with an unused port on the electronic device.

FIG. 33 shows a view of another embodiment of the invention with the second flange adjacent to one end of the electronic device.

DESCRIPTION OF THE PREFERRED EMBODIMENTS

Figure 1:
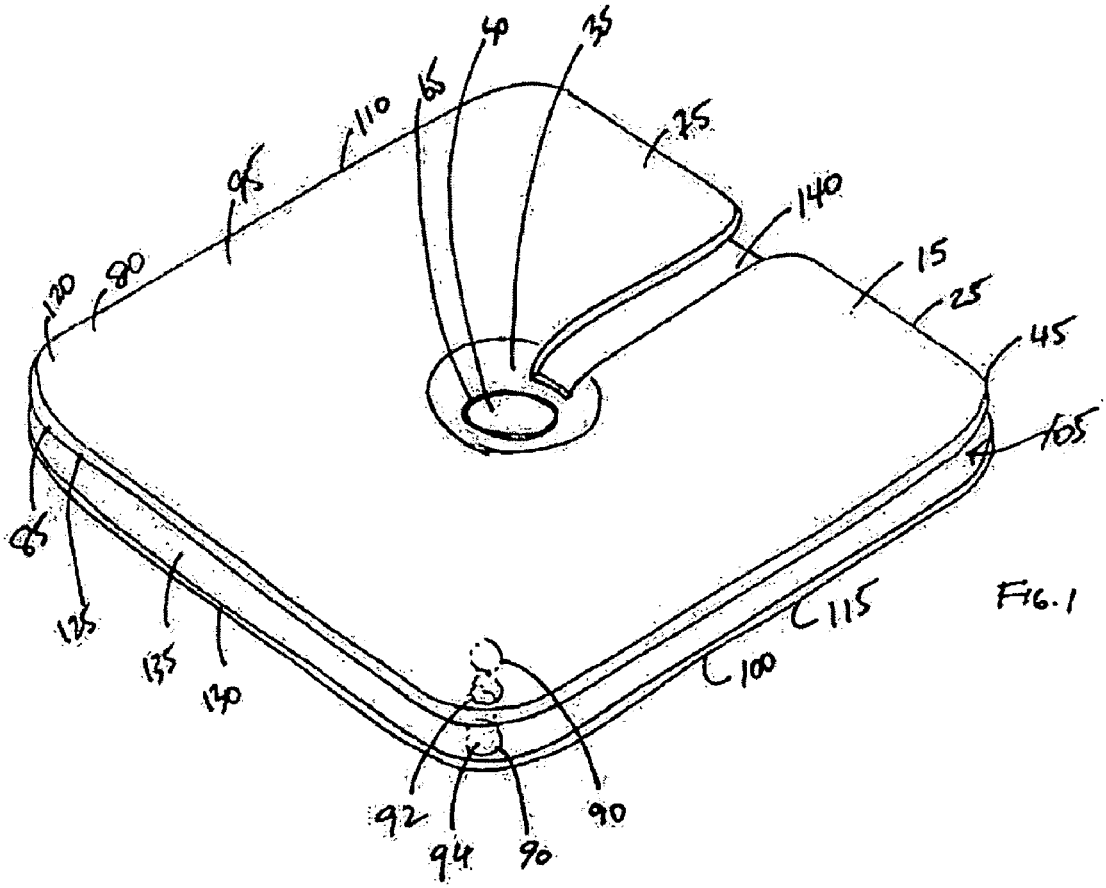
FIG. 1 is a view of one embodiment of the invention.

Referring to FIGS. 1-9, there is illustrated a cable management assembly 10, which comprises an apparatus 15 for cable management and an attachment device 20.

Apparatus 15 and Body 25:

As shown in FIG. 1-5, the apparatus 15 comprises a body 25 with an attachment area 30 near the center 35, an axis 40, which runs through the center, and at least one planar flange 45 or planar web 45, which extends from the center of the body. The center of the body can be hollow and define an open space 50, wherein a separate attachment device 20 can engage and interact with the body 25.

The body 25 is similar to a spool; the cable 55 is wrapped around the body and around the axis 40 of the body in one plane 60 to keep the cable or cord 55 from twisting and becoming not uniformly arranged within the apparatus. For this particular embodiment of the invention, this apparatus 15 keeps the cable uniformly wound around the body so that the cable is wound around a single plane, which lies perpendicular to the axis of the body.

Figure 17:
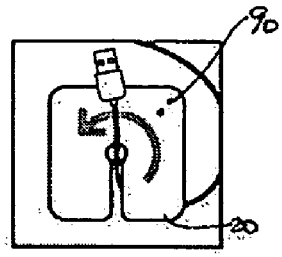
Figure 18:
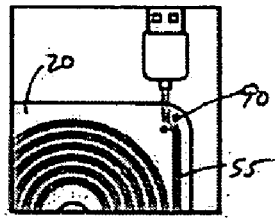

In other words, if the axis of the body were the Y-axis on an X-Y chart, then the cable would be wound around the Y-axis, and the wound cable would grow perpendicular to the Y-axis and outwardly from the center along the X-axis (FIGS. 17-18).

Figure 6:
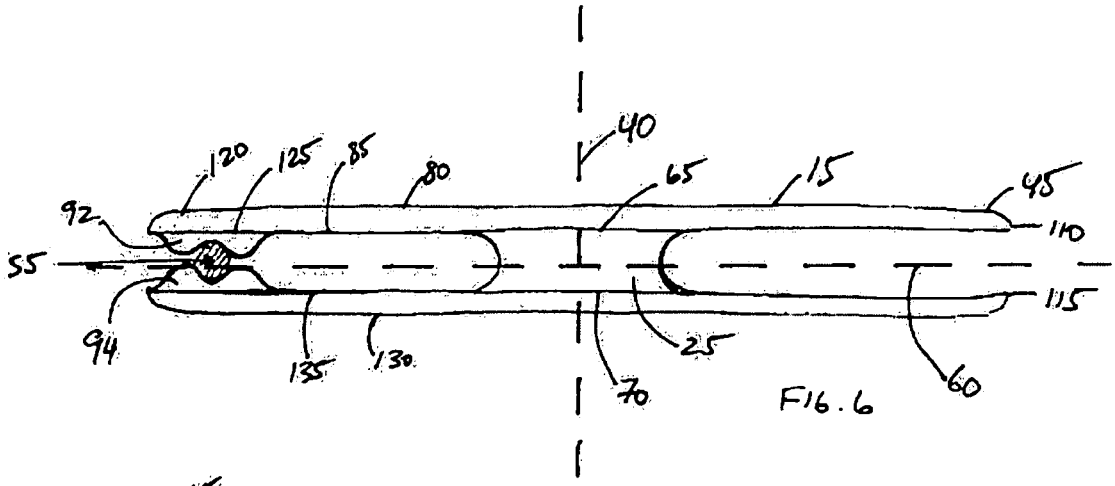
FIG. 6 shows a side view of one version of the invention with the cable receptors engaging a cable.

As shown in FIG. 6, the body 25 has a first end 65 and a second end 70. The shape of the body can be circular, square, triangular, or any irregular shape. The center 35 of the body can also be semi-hollow or completely hollow to allow unhindered passage through the body. This hollow center may also provide an attachment area 30 for an attachment device 20. The body can also have multiple openings or attachment areas in the center to accommodate multiple attachment devices. In alternate embodiments, the center of the body may be solid and may include a male end or a female receptor end; the corresponding attachment device would also have a female receptor end or a male end, respectively.

Planar Flange 45:

At least one planar flange or web 45 extends outwardly from the center 35 of the body and in an orientation that is substantially perpendicular to the axis 40 of the body. The at least one planar flange has at least one surface 75 and a first side (outer) 80 and a second side (inner) 85; the second side of the at least one planar flange has at least one cable retainer 90 or module.

In the preferred embodiment of the invention, there is a first planar flange 95 (or first planar web), which arises from the first end 65 of the body, and a second planar flange 100 (or second planar web), which arises from the second end 70 of the body. The two planar flanges 95, 100 are oriented in a parallel fashion to one another and define a cable storage space 105 to allow the axial coiling of a cable or cord in a uniform and neat manner so that the cable is coiled along one plane 60 and around the axis 40 of the body. This cable storage space 105 is formed by the two planar flanges and the body. The dimensions of this space will depend on the type of cable being used, but without being limiting, most consumer use will be typically for 2-5 mm cable (thickness).

The two planar flanges 95 and 100 are also oriented in a substantially perpendicular orientation with respect to the axis 40 of the body. In the preferred embodiment, the planar flanges lie perpendicular to the axis of the body, and the peripheral and terminal edges 110 and 115 of the first and second planar flanges, respectively, should substantially mimic and mirror each other. Each flange can have at least one terminal edge.

The first planar flange has an outer side 120 and an inner side 125; the second planar flange has an outer side 130 and an inner side 135.

Shape of Flange:

The planar flanges can vary in shape; the preferred embodiment has the planar flanges in a square or rectangular shape. Other possible shapes are circular, elliptical, trapezoid, rhombic, triangular, star shaped, stylistic, artistic, irregular, letters, or branded marks. The preferred embodiment employs a square shape because many products are based on square shapes, and this invention was designed for inconspicuous use with common products.

Further, a square or rectangular shape allows for the capability of maximizing the storing ability of the apparatus. For example, a square shape allows for storing more cord than a round shape because the corners of the square may support or hold additional loops of cord beyond the boundaries of the square. This can be illustrated by drawing a circle, then being able to draw a square within the boundaries of the circle; the circle representing coils of the winded cable, and the square representing the peripheral edges of the planar flanges. Based on one embodiment of the invention with the dimensions of 80 mm (length and width) and 9 mm (thickness) with a 3.5 mm cord, the corners of the square can hold an extra two loops of the 3.5 mm cord beyond the limit of the square for a total of approximately an extra 20 inches or 50 cm of additional cord storage.

This apparatus provides for a clean, neat, and orderly coiling of material with no internal cord overlap and no wastage of space; as the diameter of the coiled cable grows, each turn of the cable within the apparatus increases the length of the cord that can be held within a loop, and the final turn of the loop holds approximately 24 cm of cord. The cord capacity can vary and depend on the dimensions of the apparatus and the type and thickness of the cord. For example, using a 3.5 mm cord, one embodiment may hold 6-8 feet or 180-240 cm of cable. The preferred embodiment allows for usable cord size up to 5 mm in diameter and for data and low voltage cables.

In another version of the invention, there can be allowances for different distances between the first and second flanges; the type of cord or cable being used would determine the distance between the first and second flanges.

The planar flanges may also have areas on the inner or outer sides for branding or advertising marks. The color of the planar flanges can vary and match a particular type of product color or packaging. The planar flanges can also be comprised of transparent and see-through materials. The flanges may also have one hole or opening or multiple holes or openings, which allow the user to watch the progression of the cable through the cable storage space.

Channel 145 on the Planar Flange:

The first planar flange can also have at least one channel 140 that runs from approximately the center 35 and the first end 65 of the body to the peripheral and terminal edge 110 of the first planar flange. Other embodiments allow for a multitude of variations and positions of channel(s) on the first and/or second planar flanges, but the preferred version of the invention has only one channel on the first planar flange.

Figure 2:
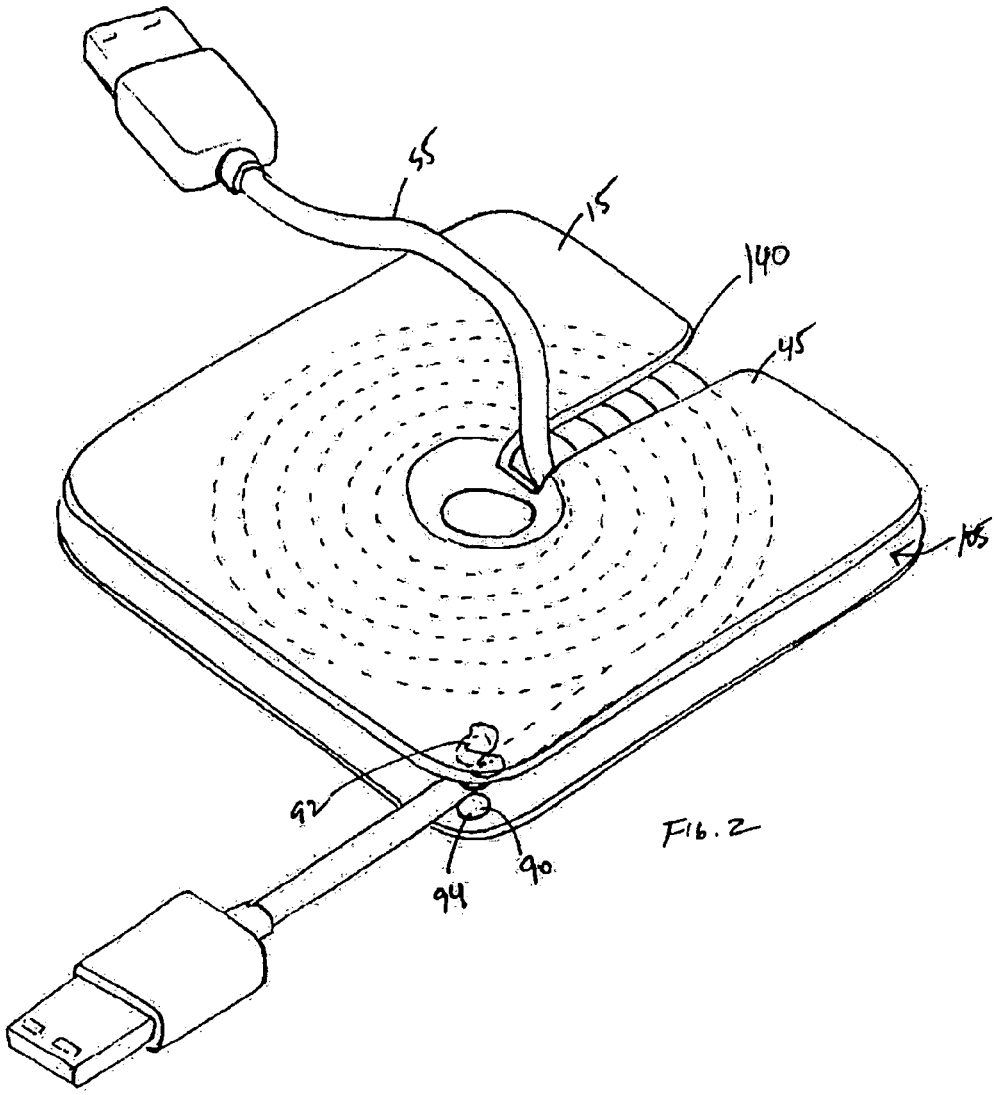
FIG. 2 is a view of one embodiment of the invention with a cable, cord, or wire wrapped within the apparatus in a single plane.
Figure 3:
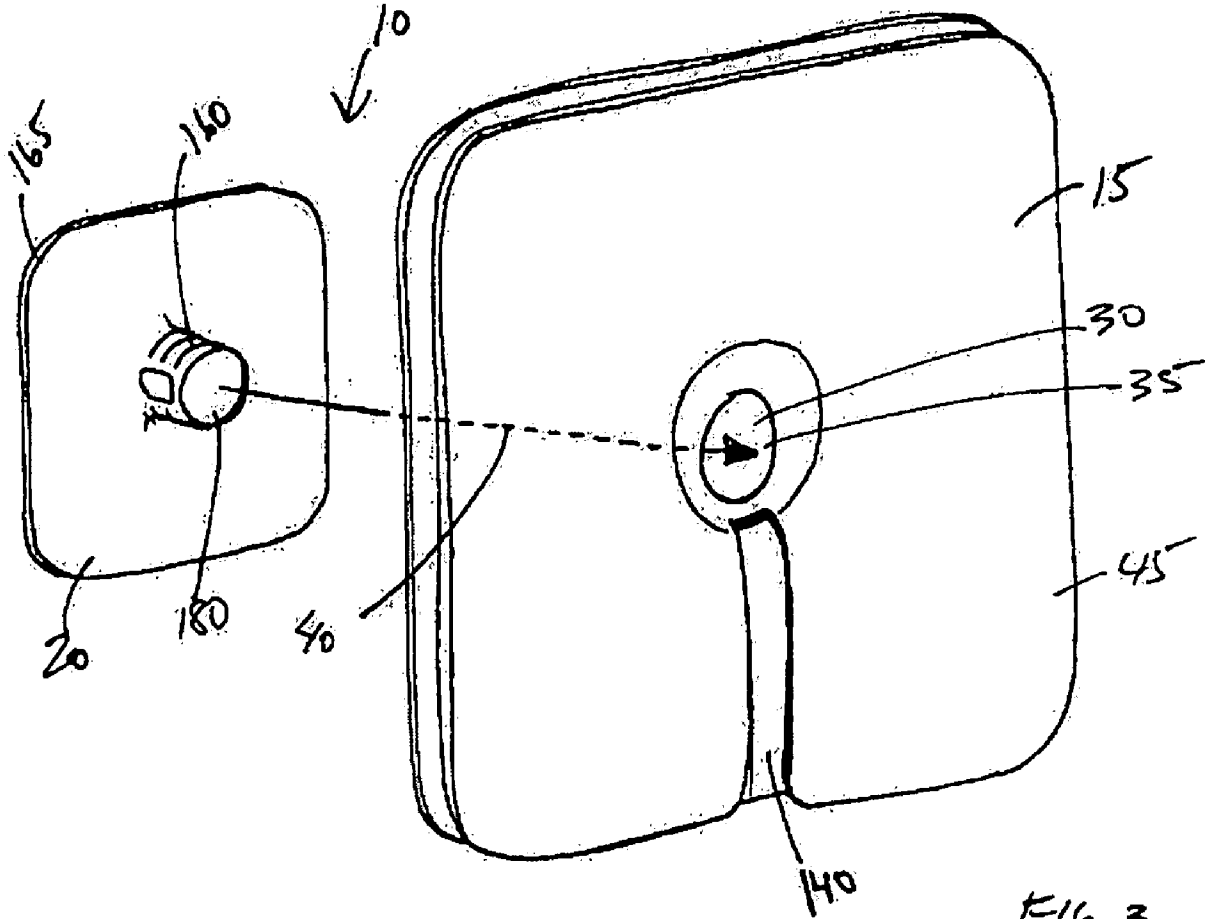
FIG. 3 is an exploded view of one embodiment of the invention, which shows the attachment device (male piece) can removably engage the center of the body (female piece).

This channel allows the user to place the cord or cable at a first or starting position on the body to begin wrapping the cable neatly and uniformly around the body and around the body axis. FIGS. 1-3 show the channel in the middle of one side of the planar flange, but the channel(s) can be placed on other locations on the planar flange.

Figure 9:
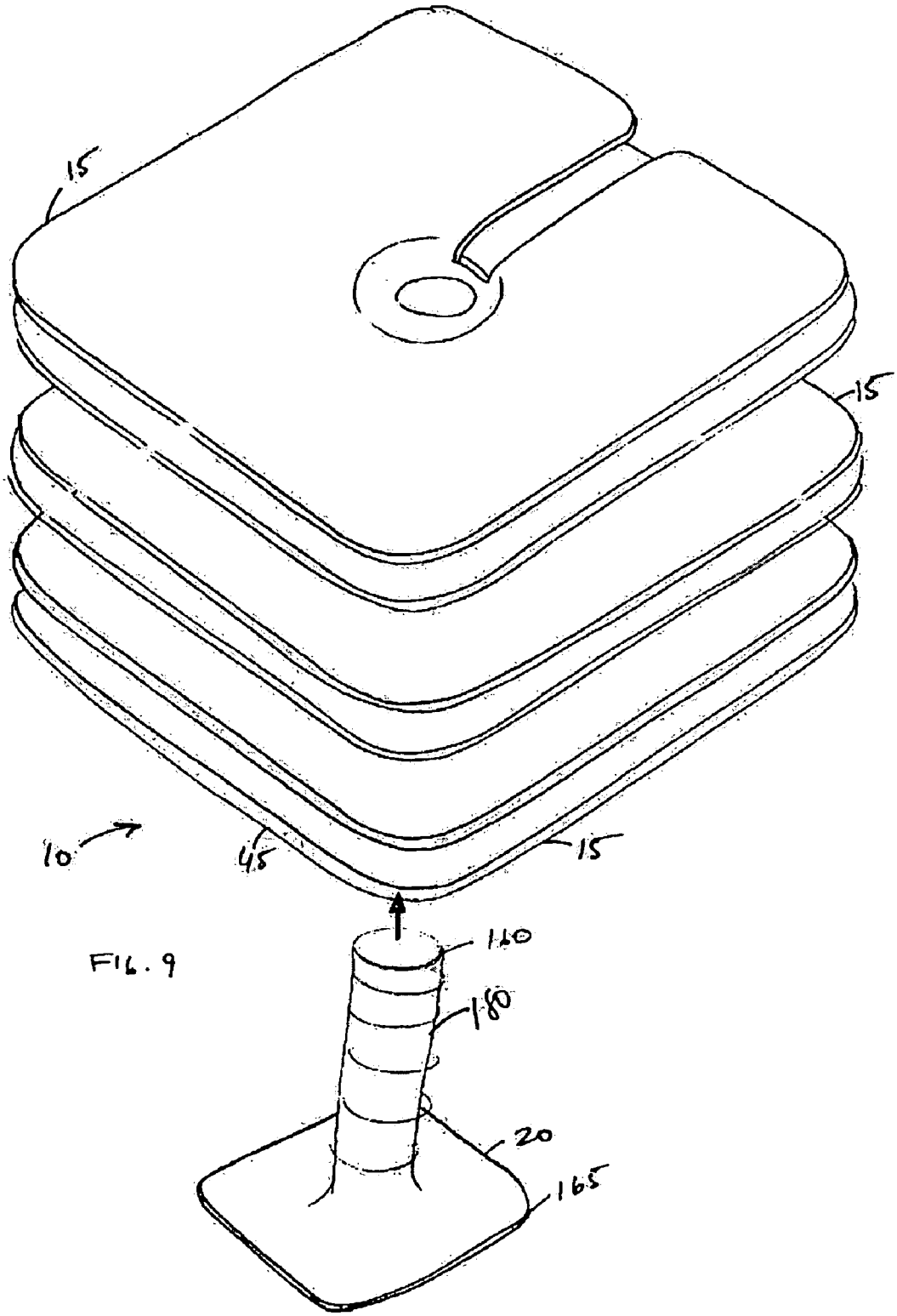
FIG. 9 shows an exploded view of an embodiment with multiple cable management apparatus stacked on and sharing one male engagement device.

The length and the width of the channel can be variable, but typically, the channel is wide enough to allow passage of the cable into the apparatus and adjacent to the body or spool. Also, other embodiments may allow for a slightly wider channel to allow more than two cables to lie simultaneously (side by side) along the channel. In multiple attachment embodiments, as shown in FIG. 9, to allow the apparatus to be placed as closely together on the second end of the attachment device, a wider channel allows two apparatus 15 to be placed closely together and to allow two separate cables 55 to pass along the channel to the outside of the apparatus. As a result, when two apparatus are sandwiched together, then this channel allows the cables from blocking the sandwiching or placement of multiple apparatus as flat as possible and next to one another.

Cable Retainer or Projection 90:

The planar flange can have a first planar flange side (outer side) 80 and second planar flange side (inner side) 85. On the second planar flange side, there is at least one cable retainer 90. As shown in FIGS. 1, 2, and 6, the apparatus has a cable retainer, projection, nub, bump, bulge or protrusion on the first and second planar flanges (numbered 92 and 94, respectively).

These cable retainers can be various shapes. For example, FIG. 6 details each retainer being smooth, circular, and forming two peaks and a valley; the cable can be placed between the two peaks in this valley. When a cable retainer on both the first and second flanges are positioned facing either other, they can form a space 145, in which a cable can be positioned. This space 145 formed by the retainers can be a geometric or elliptical shape. These examples are not intended to be limiting but are shown to illustrate the variety of different shapes for operable cable retaining members.

The first and second flanges define a first cable retaining distance, which is along the axis of the body, and the first and second cable retainers are oriented such that said retainers face one another and define a second cable retaining distance, which is along the axis of the body and is less than the first cable retaining distance. Further, if only one flange has a cable retainer or projection, then the distance between the cable retainer and the opposing surface (other planar flange or other device) would also be less than the first cable retaining distance (See FIG. 7).

The retainers 90 act like teeth to grasp the cord 55 with frictional resistance. The first and second cable retainers 92 and 94 engage the cord or cable as it enters and exits the apparatus, and these retainers allow spiral winding on a single plane, which lies transversely to the axis of the body. These retainers are generally inwardly facing projections.

Figure 7:
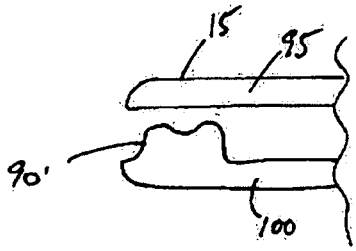
FIG. 7 shows a close-up side view of an embodiment with one cable retainer on only one planar flange.

In FIG. 7, another embodiment of the invention shows only one cable retainer 90' structure on one planar flange; this can be either the first or second planar flange. The cable will be removably fastened and held between the second or inner surface of one planar flange and the cable retainer on the other planar flange.

Figure 8:
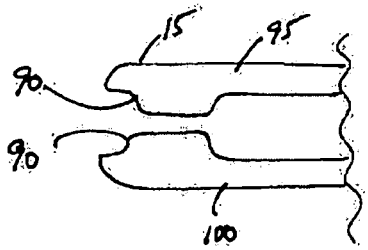
FIG. 8 shows another close-up side view of another embodiment with cable retaining devices on both on the first and second planar flanges.

In FIG. 8, another embodiment shows a different shaped cable retainer with relatively smooth surfaces. In addition, instead of a relatively smooth surface, the cable retainer surface can be serrated or irregular to provide some additional frictional resistance, which can be relatively easily overcome when the user wants to secure or to release the cable or cord. Each cable retainer can be composed of multiple retaining devices, for example, comb-like or bristle-like structures or members that can provide frictional resistance to the cable.

These retainers typically are constructed of the same material as the rest of the apparatus, but other embodiments may employ different materials than the rest of the apparatus. These retainers should allow for enough holding force or frictional resistance to fasten the cable until the user desires to remove the cable from the grasp of the retainers. However, this frictional resistance and the retainers should not prevent the axial winding of the cable around the body.

The single winding plane 60 can be perpendicular or substantially perpendicular to the body axis 40. Because these cable retainers 90 are aligned with the same winding plane 60 as the cable 55, the user will not have to twist or tilt the cable in an alternative direction (such as up or down) or another angle from the winding plane during winding or unwinding of the cable from the body apparatus.

By not preventing the securing within the cable retainer(s) and the spiral winding of the cable around the body in a single plane, this invention prevents against unnecessary bending or twisting of the stored cable. Allowing motion in the same circular direction around the axis is very useful for winding and securing the free end of the stored cable in tight areas or spaces, which may not allow for a lot of movement or a full range of movement.

Also, a singular plane of winding and the coincidental orientation of the space between the cable retainers with the winding plane allow the apparatus to be as thin as possible because there is no need for extra space between the first and second flange for the proper operation of the cable retainers. The user is moving the cable through the same plane and area shared by both the cable retainers and between the two planar flanges.

Further, once the cable is placed within the apparatus, the user will not need to twist or move the cable along the axis of the body, and the user will only need to provide force around the axis 40 and not along the axis of the body.

Since the cable retainers are aligned and oriented to hold the cable within the same plane, which is perpendicular to the body axis, this invention also allows for the user to easily grasp the free end of the cable with the user's fingers (of the right hand) and to allow the user's thumb to press against the edge of the planar flange and to provide an opposite axial force to release the cable from the cable retainers. This elegant and simple design allows for simplified winding and unwinding of the cable with minimal twisting or bending.

Additionally, these cable retainers allow a user to unwind a coiled cable with one hand. Since the user applies an axial force to wind the cable, at the same time, the user also can apply the same force to overcome the frictional resistance of the cable retainer through each pass of the loop. As a result, one can use the same axial force for winding/rewinding and grasping and releasing from the cable restrainers. This invention also allows for the winding of the cable with one hand. Unwinding is a little easier one handed, but a user with a skillful hand can also wind and secure the cable as well.

In the preferred embodiment, the cable retainers are positioned at or near the peripheral or terminal end of the planar flange and near a corner of the apparatus. However, these cable retainers can be placed on various positions of the apparatus. In the preferred embodiment, the channel would lie at the twelve o'clock position, and the cable retainers can be placed at either the four or eight o'clock positions. These positions and orientations of the cable retainers and the channel are not intended to be limiting, but merely to illustrate the preferred embodiment.

If there is more than one cable retainer (one or more on each of the opposing planar flanges), then the cable retainers preferably are oriented such that said retainers face one another to define a retaining area wherein the cable can be removably secured between the retainers; the first and second flexible cable retainers are oriented such the distance between the cable retainers is less than the distance between the first and second planar flanges; the first and second flexible cable retainers are further oriented such that the cable is able to be wound uniformly around the axis of the body, whereby the cable can be placed through the channel on the body, wrapped around the axis of the body in a substantially uniform manner to avoid twisting and overlap of the cable, and held into place by the at least first and second flexible cable retainers.

In another possible embodiment, there also could be multiple cable retainers that are located on different areas of the first or second flanges; these cable retainers do not need to face one another, but could face either an opposing flange or flange surface as shown in FIG. 7.

One-Piece Construction:

The preferred embodiment of the invention has the apparatus 15 comprised of one piece of plastic, but other materials such as metal, aluminum, alloy, carbon fiber, wood, or other firm material, which may allow for some flexibility, are usable. This one-body construction allows for easier fabrication, i.e. injection molding process, and also for less parts and lower costs.

Attachment Device 20:

The attachment device 20 removably engages the center 35 of the body at the attachment area 30 to allow the apparatus to removably engage a surface 150 or a device 155. The attachment device 20 can be removably or fixedly attached to another separate surface. The attachment device has a first attachment end 160 and a second attachment end 165; the first attachment end 160 removably engages and interacts with the center of the body; the second attachment end 165 engages a separate surface, including but not limited to the outer surface 150 or casing of electronic devices, furniture, tables, chairs, monitors, bookcases, and computers.

In the preferred embodiment, the first attachment end 160 acts as a male piece to interact with the center of the body, which acts as a female piece. The male piece may also have ribbing or other protrusions to provide additional frictional contact for the mating of the attachment device to the apparatus.

Other possible attachment interactions can also be used, including but not limited to a clasp and screw-type connections and multiple male/female connections. The length of the first attachment end 160 can also vary to lengths greater than the thickness of the body and the planar flanges; for example, as shown in FIG. 9, multiple apparatus are attached to a single male attachment end to allow compact stacking of coiled cables.

In the preferred embodiment, the second attachment end 165 has a permanent adhesive surface 170 (FIG. 4), but other embodiments may employ a suction cup 175 (FIG. 5), screw-type or threaded connections, hook and loop attachments, clasps, clips, male and female interacting attachments, and other permanent or removable attachment devices.

Male and Female Versions of the Attachment Devices:

In the preferred embodiment as shown in FIG. 3, the first end 160 of the attachment device is a male piece 180, which removably engages and interacts with a reciprocal female engagement area 30 on the center of the body of the apparatus.

Figure 10:
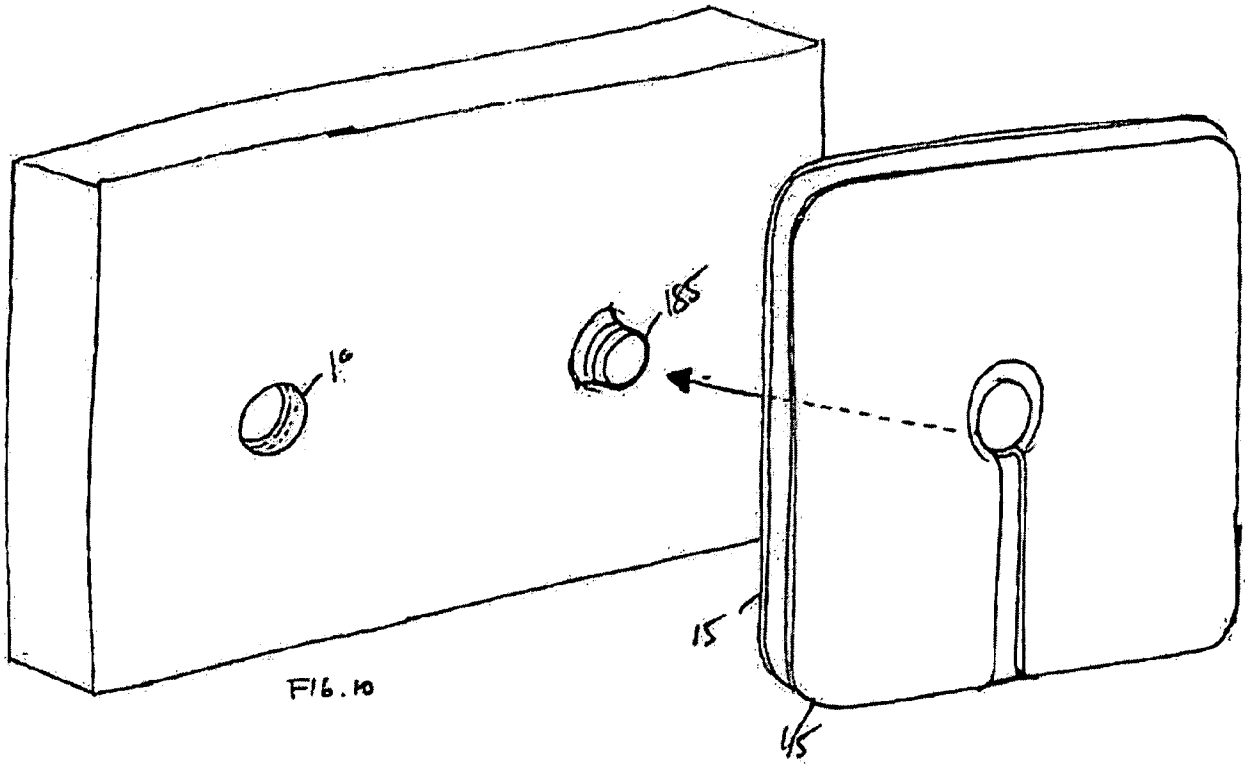
FIG. 10 shows an exploded view of another embodiment wherein the male engagement device is molded integrally to the surface of the electronic device.
Figure 11:
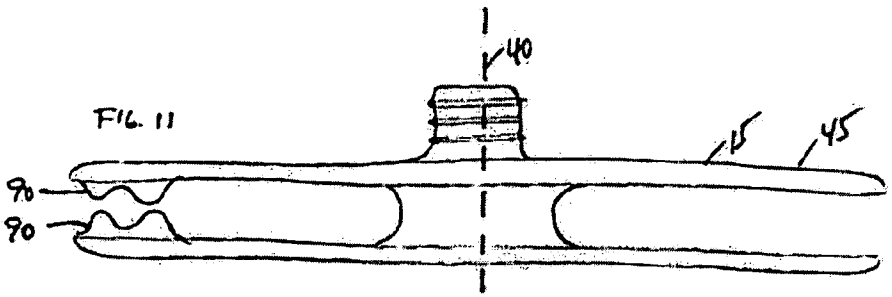
FIG. 11 shows a side view of an embodiment of the invention.

However, in other embodiments, the attachment device 185 can be physically molded or incorporated or integrated into the surface (of the item that the user wants to attach the cable management apparatus) as shown in FIG. 10.

Multiple Apparatus: As shown in FIG. 9, the multiple apparatus can be combined on a single attachment device. In this embodiment, the attachment device acts as a male piece and removably interacts through the engagement or attachment area of the center of each of the body. This version of the invention allows for further management of multiple cables from multiple devices in a very small and compacted area.

Attachment Devices Molded to the Apparatus:

In addition to using a separate attachment device as described above, this invention also allows for attachment devices, including but not limited to, clips, hook and loop style attachments, buttons, clasps, and male/female mating connections, to be either physically molded or integrated to the exterior or outer surface of either the first or second flange. These attachment devices may also be separately attached to the flange surfaces or by connection to the center of the body.

Figure 12:
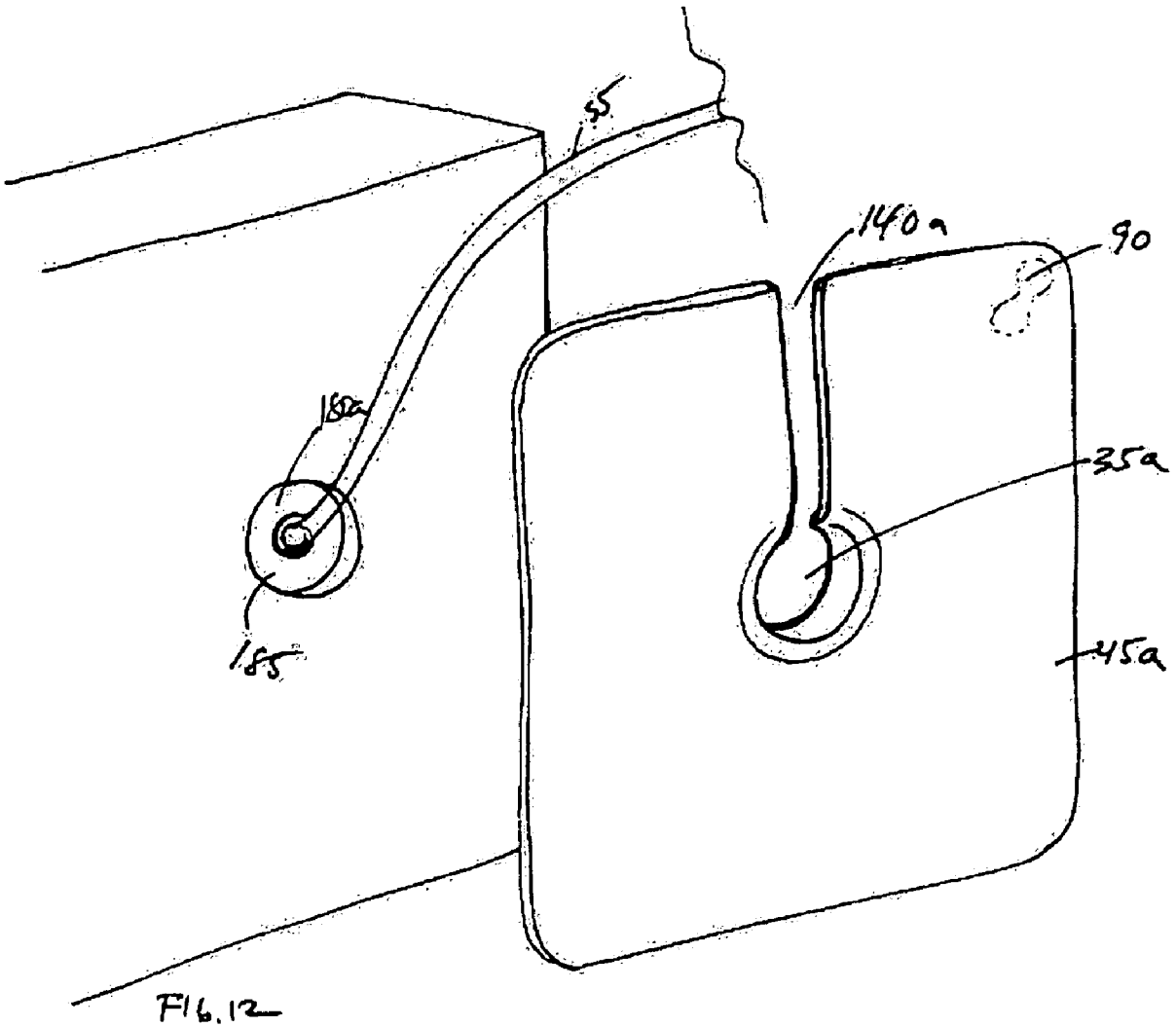
FIG. 12 shows a view of another embodiment of the one-planar flange version of the invention wherein the male engagement piece is integrally molded or attached to the electronic device or surface and engages the female receptor on the one-planar flange.
Figure 13:
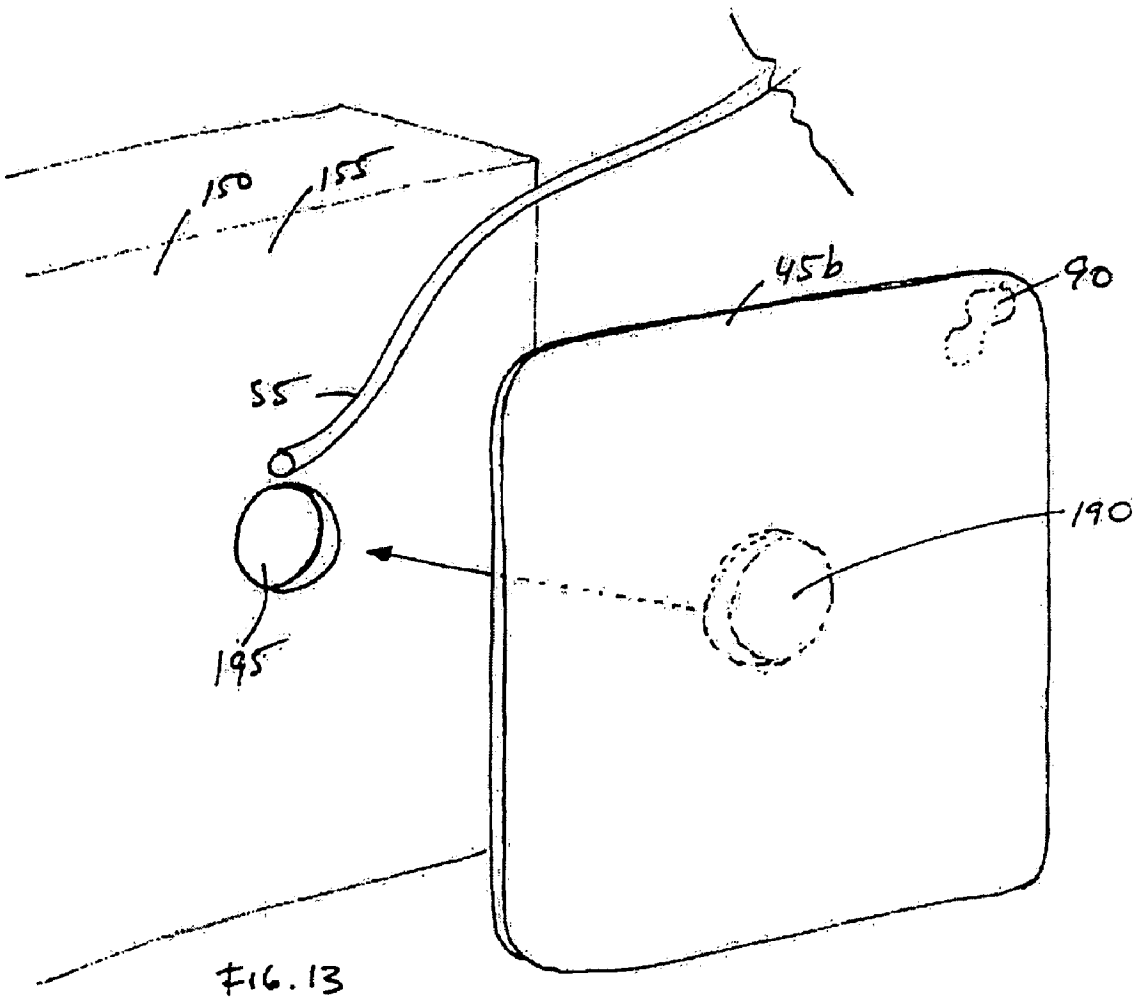
FIG. 13 shows an exploded view of another embodiment of the one-planar flange version of the invention wherein the male engagement piece is integrally molded or attached the one-planar flange; this male engagement piece can removably attach to a female receptacle on an electronic device or surface.

One Planar Flange Version:

FIGS. 12 and 13 show alternative versions of the invention allowing for only one planar flange on the apparatus. In FIG. 12, the one planar flange 45*a* has a channel 140*a* and a center 35*a* with an attachment area 30*a* as in the preferred embodiment, but the body of apparatus is formed from the male attachment piece 180*a* or end, which protrudes from the surface of the device or item. FIG. 12 shows a cable 55 also protruding from the attachment end 185.

FIG. 13 shows another embodiment where the planar flange 45*b* has a male end 190 and the surface 150 of the item or device has a female receptor area 195. The center of the planar flange 45*b* can have a male receptor end and no opening in the center of the planar flange.

Figure 14:
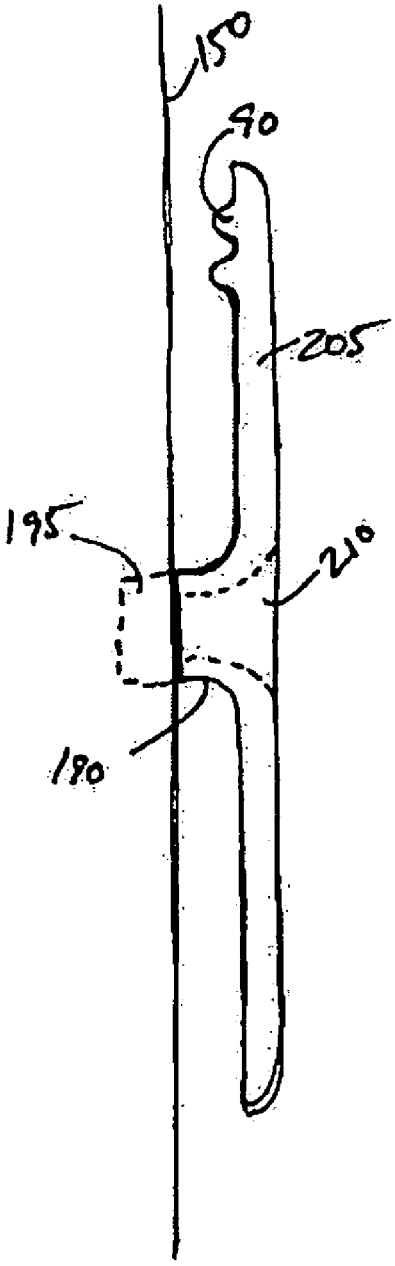
FIG. 14 shows a side view of one embodiment of the one-planar flange with a male piece, which removably engages the surface of a device; note that the dotted lines show this embodiment to have a hollow area in the center of the planar flange, which may allow for access of the cable of the device.
Figure 15:
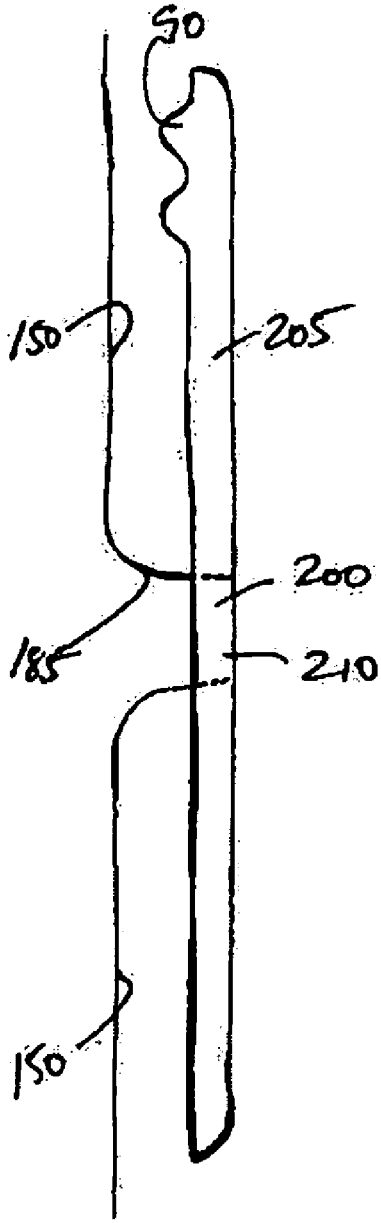
FIG. 15 shows a side view of another version of the invention with one-planar flange having a female engagement area, which removably interacts with the attachment device (male piece) from a separate surface.

As shown in FIGS. 14 and 15, another embodiment of the invention has a single planar flange 205 with at least one cable retainer 90. These single planar version embodiments will removably engage mating parts (male or female mating pieces), which are molded or integrated directly on to the surface to be attached. FIG. 14 shows a body with a single planar flange; the single planar flange has at least one cable retainer 90, which preferably will face or be oriented towards the contact surface 150; this embodiment mates with or is removably attached to a receptor area 195 on the contact surface. The center of the flange can define an open space 210; this would allow a cable or cord to pass through this space; there also can be a channel (not shown).

FIG. 15 shows a single planar flange 205 with at least one cable retainer 90, which is preferably oriented toward the contact surface 150, and a receptor area 200 near the center of the flange; this flange can removably engage with a male attachment 185 on the contact surface; this embodiment may also have a channel (not shown).

One Planar Flange Integrally Molded to a Device:

Another embodiment allows for a single planar flange and a body being integrally molded to a surface of an electronic device or a surface of a work space. As with the above embodiments, this single planar flange can also have at least one cable retainer; there may also be a channel. For example, this invention could be integrally molded to a power charger or adapter to provide an inconspicuous and easy way to manage the cable.

Another Embodiment to the One Planar Flange Version:

As shown in FIG. 45-53, there are other variations of the one planar flange version. This embodiment can be used with any device with a cable or cord. This version of the apparatus for managing a cable for a device with a surface has a body with an axis and a center; the body has a first end and a second end; the first end has a first planar flange; the first planar end and the surface of a device are in a parallel orientation to one another and are oriented substantially perpendicular to the axis of the body; the first planar flange and the surface of the device define a first cable retaining distance, which is oriented along the axis; the first planar flange has substantially open and non-fused peripheral edges; the first planar flange has at least one first planar flange surface, which has at least one first cable retainer near the peripheral edge of the first planar flange; the at least one first cable retainer is oriented such that said retainer faces the surface of the device and defines a second cable retaining distance, which is along the axis of the body and is less than the first cable retaining distance; the cable can be removably secured between the at least one first cable retainer and the surface of the device; the at least one first cable retainer allows axial winding of the cable around the body and in a single winding plane and beyond the peripheral edges of the first planar flange, whereby the cable wrapped around the axis of the body in the single winding plane and in a substantially uniform manner, and held into place by the at least first cable retainer and the surface of the device.

The second end of the body can have various ways to engage the surface of the device, permanently or temporarily or can be intentionally removed by the user using various devices including but not limited to an adhesive surface, a suction cup surface, a male/female interaction, or a hook and loop interaction/connection.

For the male/female interaction, the second end of the body can be a male piece, which removably attaches to a cavity or area on the device; this cavity or area is at a lower or different elevation than the surface of the device. Similarly, the surface of the device could have a male piece, which lies at a separate and higher elevation in comparison to the surface of the device and removably engages the apparatus.

Figure 4:
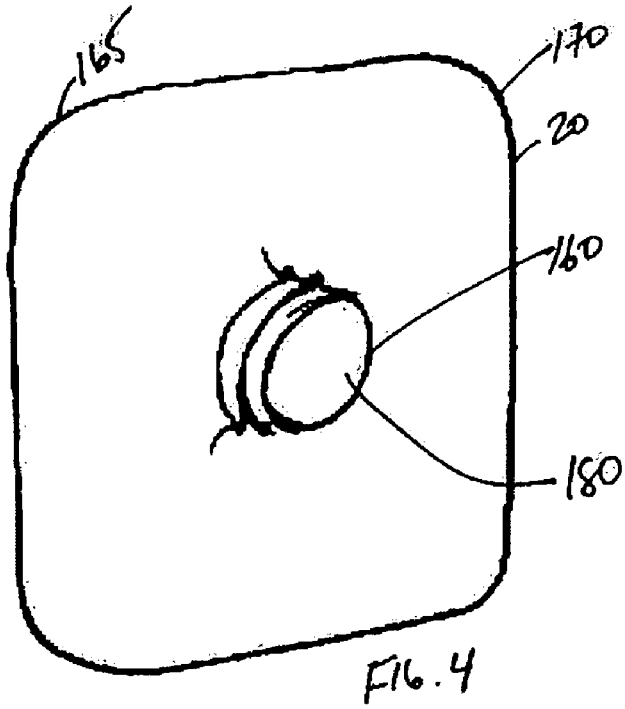
FIG. 4 is a view of one version of the attachment device with an adhesive second end.
Figure 5:
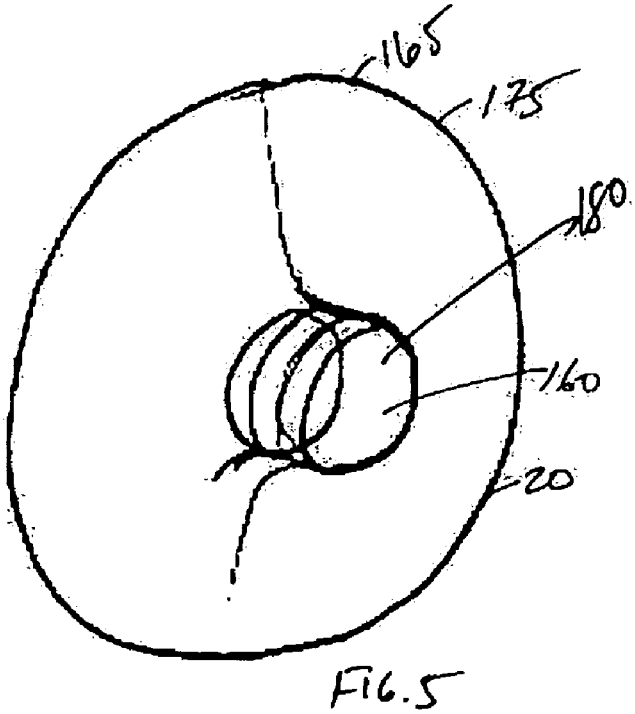
FIG. 5 is a view of one version of the attachment device with a "suction-cup" type second end.

The body can also have a hollow body center, and the surface of the device can engage the apparatus through this hollow body center. Similar to other embodiments listed above, this single planar flange version can employ the other separate attachment devices as shown in FIG. 3-5 with an engagement area in the center of the body of the apparatus. In addition, other variations of the single planar flange version with at least one cable retainer can lack a body; instead, as shown in FIG. 15, the "body" will be created from the surface 150 of the device; FIG. 15 shows a male/female interaction, but other attachment devices can be used.

As with the other embodiments above, the first planar flange can be square, rectangular, and irregular shaped and can be comprised from plastic, alloy, metal, aluminum, and carbon fiber materials. Another embodiment allows the first planar flange to have at least one channel, which extends approximately from the center of the body to a peripheral edge of the first planar flange.

Figure 45:
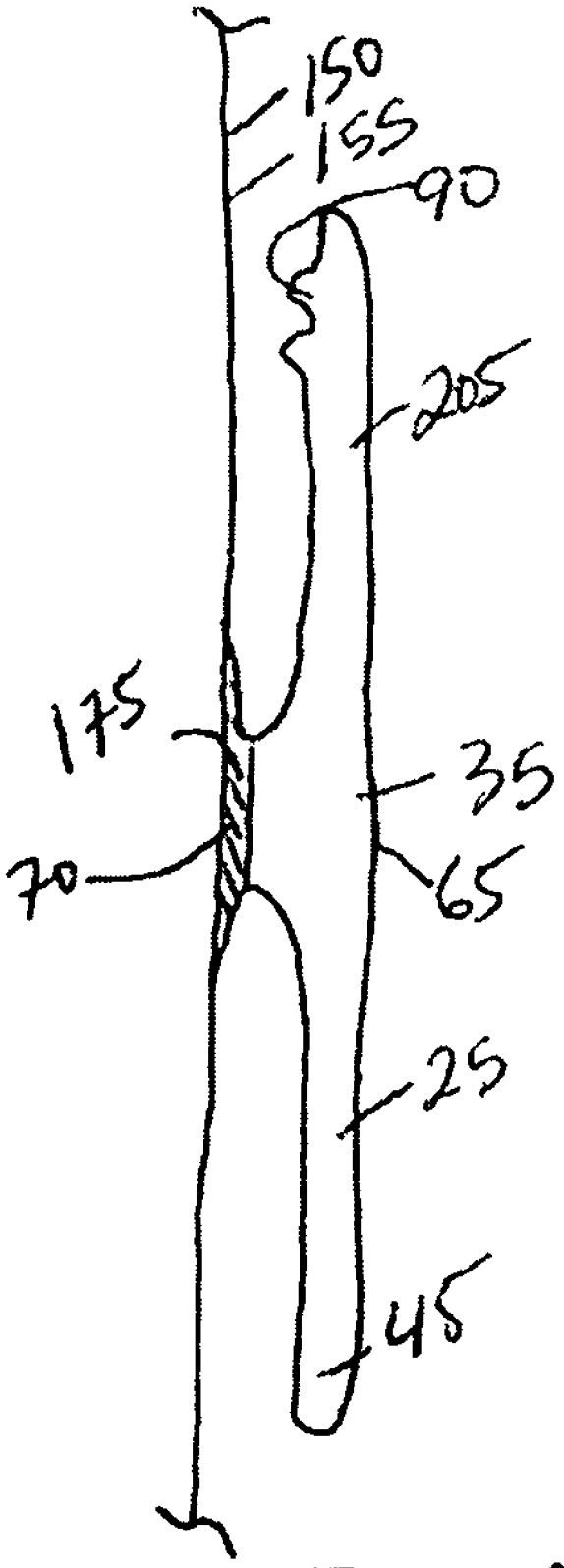
FIG. 45 shows a one flange version with at least one cable retainer on the first planar flange and a suction cup attachment on the second end of the body.

Viewing FIG. 45, there is a suction cup attachment end 175 on the second end of the body. Also, note that this figure also shows at least one cable retainer 90 on the first planar flange.

Figure 46:
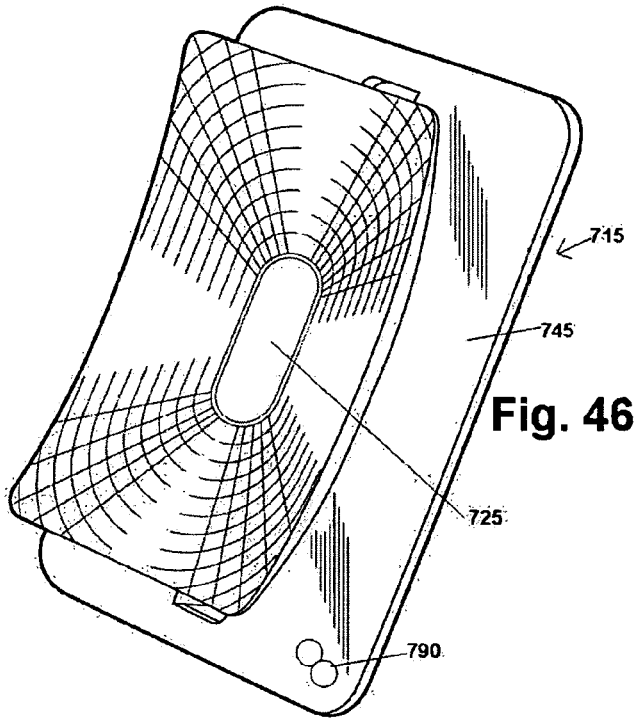
FIGS. 46-53 show different views of different embodiments of this invention.

Viewing FIG. 46, there is an apparatus 715 with a body 725 and one first planar flange 745. There is at least one cable retainer 790 on the first planar flange 745. Note also that the second end of the body has a suction cup attachment end.

Figure 47:
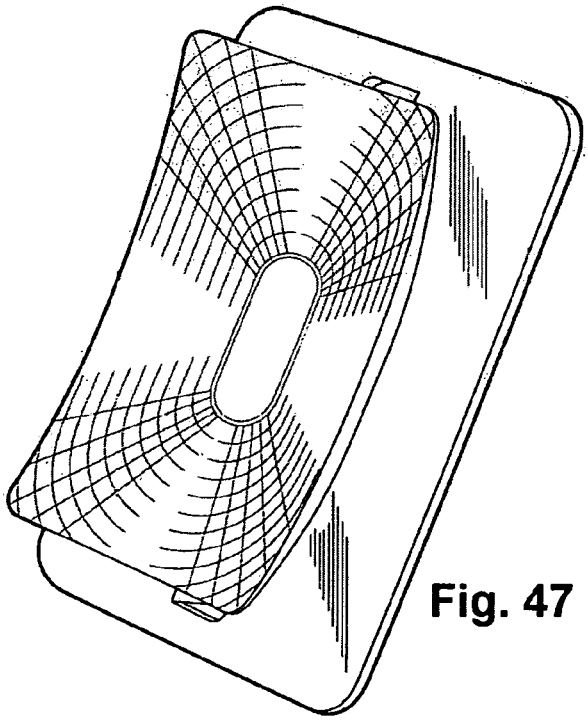
Figure 48:
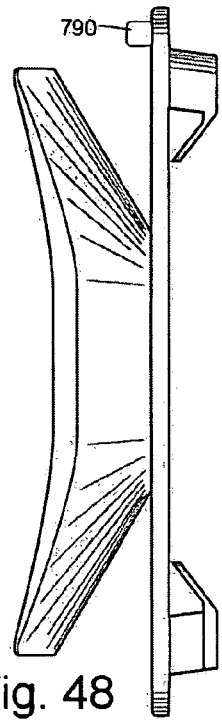
Figure 49:
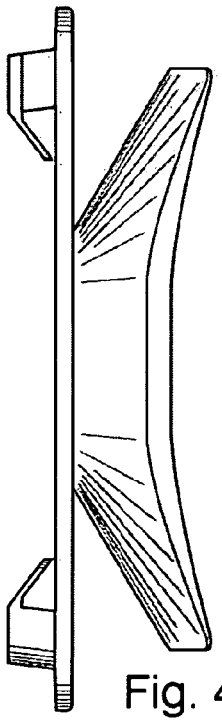
Figure 50:
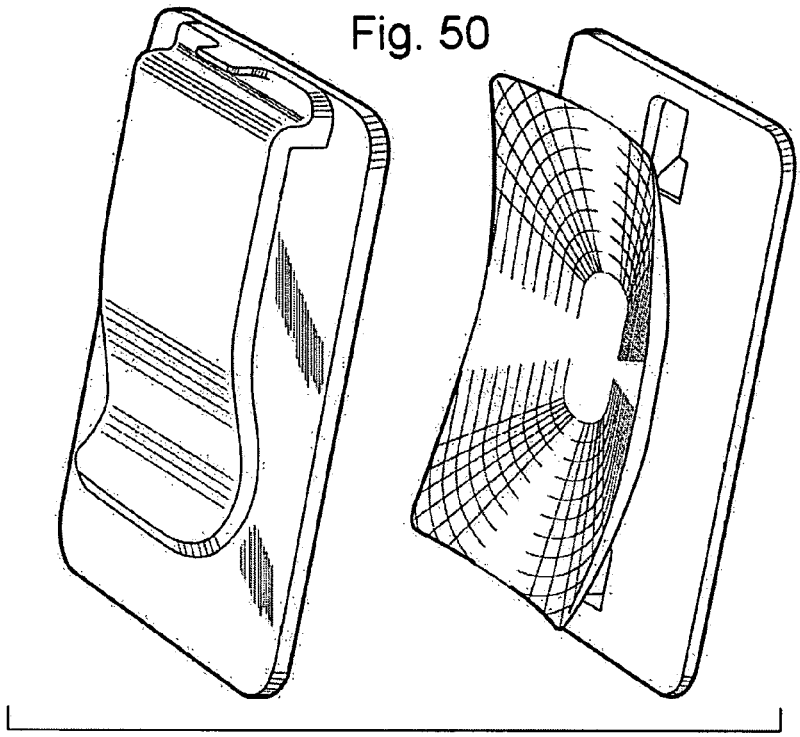
Figure 51:
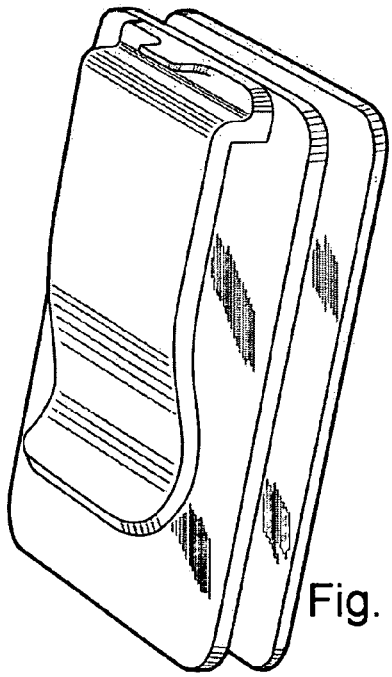
Figure 52:
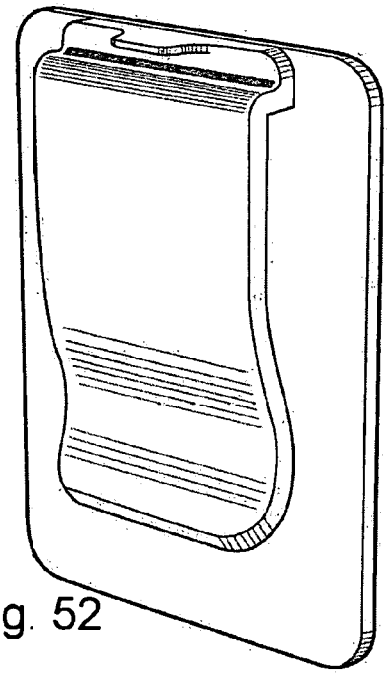
Figure 53:
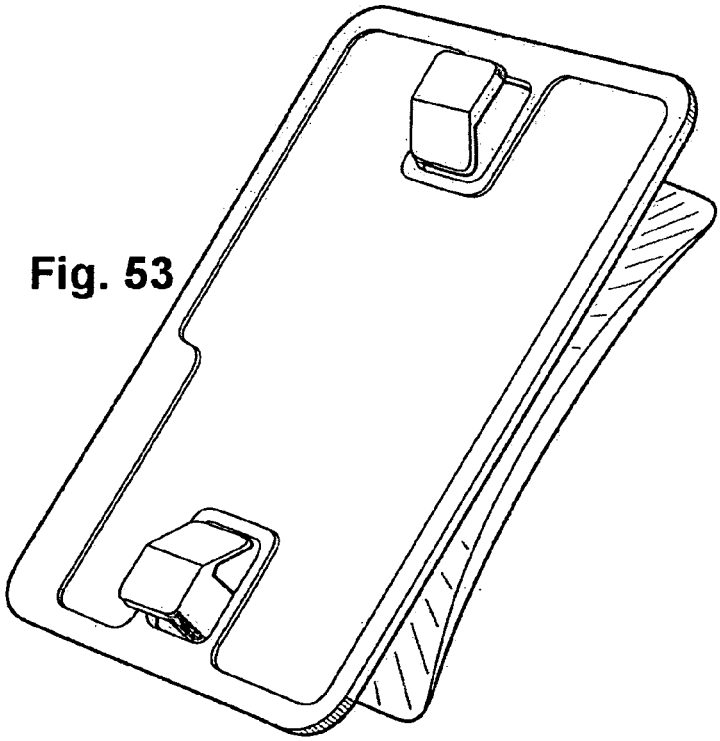

FIGS. 47 and 49 show embodiments that do not employ a cable retainer; FIG. 48 shows a side view of one embodiment with a cable retainer 790 on the first planar flange. FIGS. 48 and 49 also show embodiments that use clips or hooks on one surface of the planar flange. FIGS. 50, 51, and 53 show embodiments that have the suction cup apparatus being removably attached to a separate clip piece, which can be mounted on a belt, clothing, bag and the like. As noted above, these drawings show one particular way to removably attach the second end of the body to a separate surface, but other possible attachment devices could be employed such as hook and look, male/female interactions, clasps, buttons, and other like devices.

Figure 16:
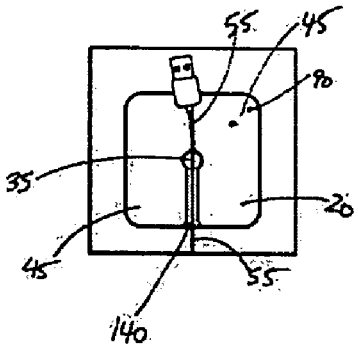
FIGS. 16-18 shows the progression of steps of engaging a cable in the center of the apparatus, winding the cable in a uniform and neat manner around the axis of the body, and removably engaging the cable to the cable retainers.

Method of Using the Invention:

As shown in FIG. 16-18, the user places or aligns the cord 55 along the length of the channel 140 and enters the interior portion of the apparatus through the channel and in between the planar flanges. In FIG. 17, the cable is wrapped around the center and the axis of the body (here, the axis would be coming out of the page); FIG. 17 shows wrapping of the cable in a counter-clockwise fashion, but this invention allows for winding in the clockwise manner as well. The user can keep the first end or portion of the cord against the outer surface of the planar flange while the cord is being wound around the body. FIG. 18 shows the second end of the cord or cable being removably fastened or secured to the cable retainers.

Figure 19:
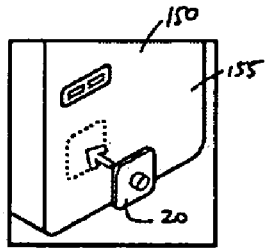
FIGS. 19-21 shows the progression of steps of fastening (either securely or removably) the male attachment device to a surface.
Figure 20:
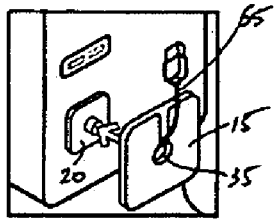
Figure 21:
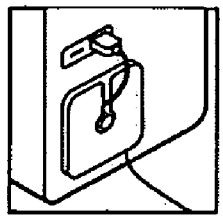
Figure 22:
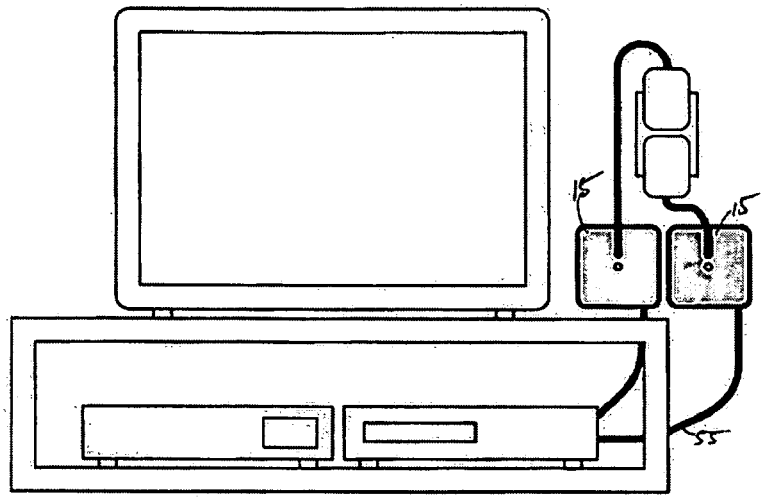
FIGS. 22 and 23 show multiple apparatus being used to manage the cables of various electronic devices.
Figure 23:
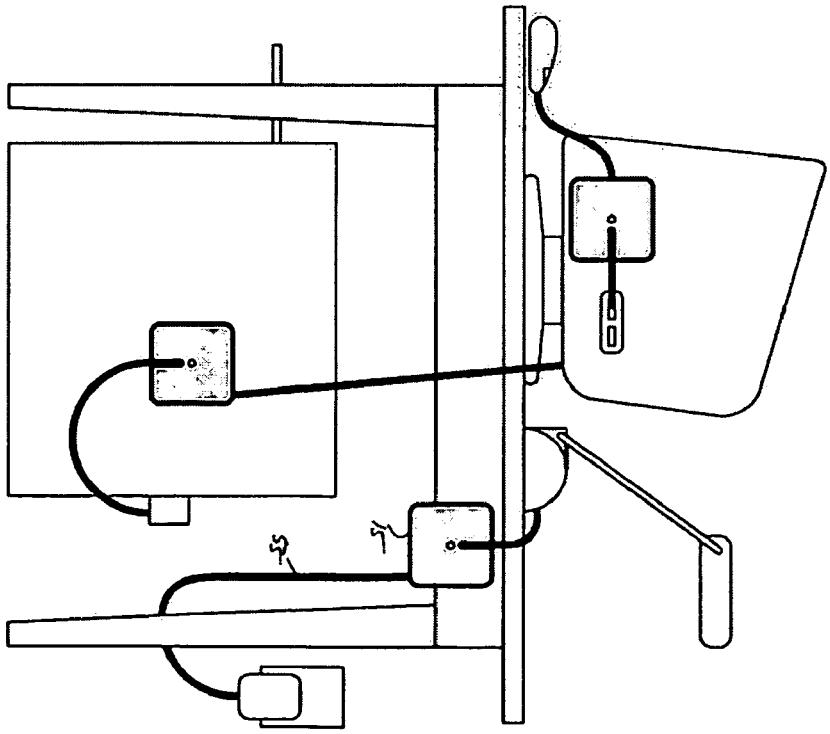
Figure 26:
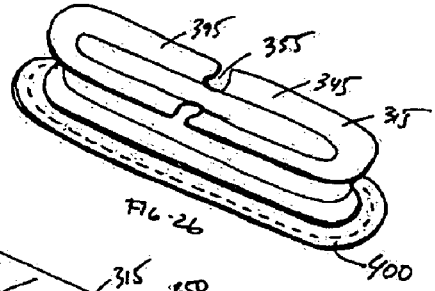
Figure 38:
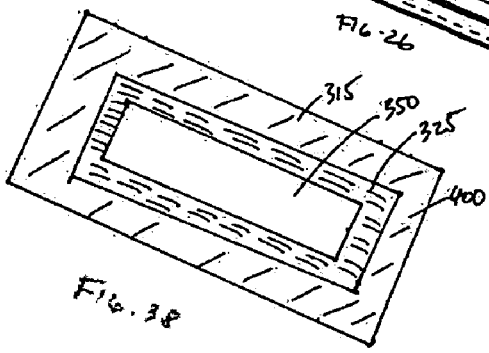
FIG. 38 shows a bottom view of one embodiment of the invention.

FIG. 19-21 illustrates how the second end of the attachment device is secured (either securely with adhesive or removably with a suction cup or other removable attachment device) to a surface 150 or a device 155; once the attachment device is secured to the device or surface, the attachment device removably engages and interacts with the center 35 of the body; FIGS. 22-23 and 22 show how this invention can manage the cable length to neatly present just enough cable to connect with a computing or electronic device.

Wire Management for Accessories for Electronic Devices:

As shown in FIGS. 24-35, another embodiment of the invention presents an apparatus 315 to manage the cables commonly associated with accessories 215 for portable electronic devices, including but not limited to headphones 216, microphones, power and data cables. This invention is suitable for portable electronic devices including but not limited to mobile phones (cellular, digital, and satellite), MP3 players (hard drive and flash drive), portable communication devices (walkie-talkies), radios, televisions, PDA, and handheld portable computing devices and games.

As shown in FIG. 24, one preferred embodiment is an apparatus 315 for managing the cables and wires for headphones 216 for an electronic device, such as a cellular phone or MP3 player. This apparatus can removably engage or be slipped onto one end of an electronic device 155.

As shown in FIGS. 24-27, there is an apparatus 315 for managing cables and wires with a spool or body 325 having a first 365 and a second 370 end. The body 325 has a center 335 and an axis 340; the body can also define a space or hollow area 350, which provides accessibility from the first planar flange area to the second flange area to allow a user to attach the cable or wire plug or adapter end 218 to the electronic device, such as a headphone output plug or jack. This space also allows accessibility to other jacks or panels on the electronic device, such as the recharge and data link interfaces.

Figure 29:
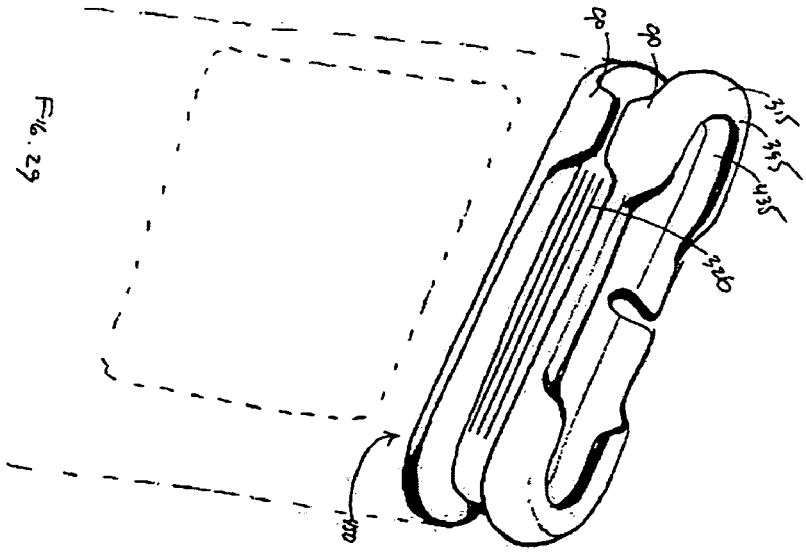
FIG. 29 shows a view of another embodiment with ribs and cable guides.

As shown in FIG. 29, the body may also have ribs or guiding members 326, which are relatively parallel to the flanges and provide guidance to the cord or cable, which are being axially wound around the body.

This invention has at least one flange 345 arising from the body 325. In the preferred embodiment, a first flange 395 extends from the first end 365 of the body; a second flange 400 extends from the second end 370 of the body. The first and second flanges both extend out from the first and second body ends to create a cable storage space 405 against the body. Other embodiments may allow for the first and second flange to be the same or different sizes with respect to one another.

Figure 27:
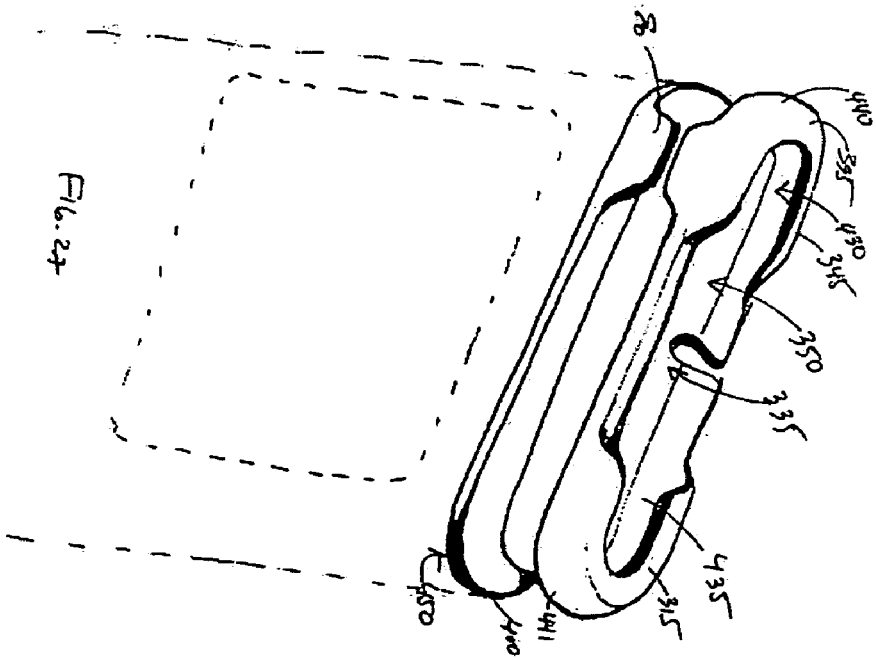
FIG. 27 shows a view of another embodiment of the invention with cable retainers along the body axis and also receptors for the headphones along the second flange.
Figure 28:
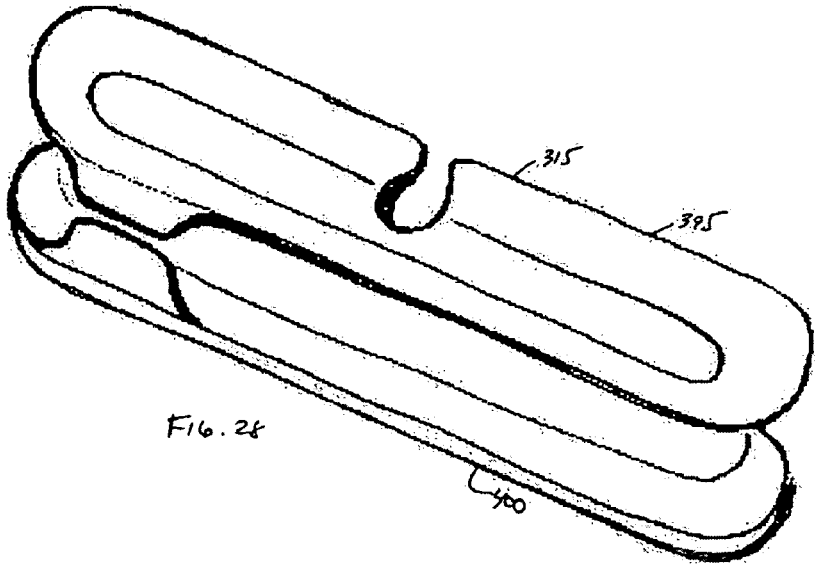
FIG. 28 shows a view of another embodiment of the invention with cable retainers.

The first flange can also have at least one aperture or notch 355, which allows for the cable or wire to be removably attached. As shown in FIG. 27, the notch(s) or channel(s) can be oriented with the axis 340 of the body 325; the cable or wire 55 will need to be placed at an angle different from the cable or cord being wrapped axially around the body.

As shown in FIGS. 27 and 29, the first flange can also have accessory storage areas 430, typically for headphones. The flange can have a variety of different storage areas formed by at least one molded groove or pocket or slot 435 to allow the headphone earpiece 217 or accessory to be removably secured to the groove with a frictional fit for easy storage and to prevent the headphone earpieces from being knocked around or damaged. These storage areas are at a first end 440 of the flange and a second end 441 of the flange. But, other embodiments allow for preformed universal grooves or female type receptors, which can receive the headphone buds (male type piece).

The first and second flanges can also have cable retainers 90 similar to the earlier above embodiments. The cable retainers can be a single retainer that arises from either the first or second flange or at least one retainer can arise from each of the flanges. As shown in FIG. 27, a cable retainer 90 arises from both the first and second flanges. These cable retainers are oriented such that the user does not need to change or to alter the direction of the cable being wound around the body. These cable retainers are facing one another such that the retainers define an open space 445 that is less than the distance between the first and second flanges. Since there is still enough open space between the cable retainers, the user is still able to guide a cord or wire through the retainers. Yet, the cable retainers provide enough frictional resistance and engage the cord as it enters and exits the apparatus to allow the user to either temporarily hold or fasten the cable similar to the embodiments shown above or merely to act as a guard against unintended unwinding of the cable. Also, flexible materials, including but not limited to rubber and flexible plastics, may be employed to allow for accessibility of a wire through these retaining elements into the wire storage area of the body.

Sleeve of Second Flange:

A second flange arises from the second end of the body. In one version of the invention, as shown in FIGS. 30-31, the second flange has a device engagement area 450, which can act similar to a skirt or cap that removably attaches to one end of the electronic device. This embodiment can be made of a flexible material, including but not limited to plastic, which allows for enough flexibility so that the second flange can slip on or over the end of the electronic device. This material should provide enough resistance for a cable or wire to be wrapped but also enough "give" or flexibility to engage and to secure the end of the electronic device until the user desires to remove the apparatus from the device. This embodiment is also useful for external microphones or other input devices. This invention may also employ flexibly resilient materials.

Sleeveless or Adjacent Version:

In another embodiment of the invention, a second flange 400 arises from the second end of the body or spool. As shown in FIGS. 32-33, instead of mating directly over or substantially around the end of the electronic device, another version of the invention provides an apparatus that lies adjacent to or "butts against" the end of the electronic device. With the connector of the accessory, for example, a headphone jack 218, being placed through the body, this frictional resistance between the headphone jack and the electronic device help to hold the apparatus adjacent to the end of the device.

Further, with the open cavity or space 350 in the spool or body that allows access to the headphone output jack, there may also be access to the other input or output jacks on the end of the electronic device. Even with the attached invention, the user may still be able to access many if not all of the jacks or controls on the end of the electronic device.

In another embodiment, if a particular accessory jack 455 is not going to be simultaneously used with the headphone jack, it is possible to use this jack as a receptacle to allow a stabilizing anchor or probe 460 to further secure the apparatus to the end of the electronic device. To ensure that the apparatus mating piece 460 does not harm or injure the end of the electronic device, the mating piece should be small and inconspicuous, but also large enough to partially mate with the non-used jack receptor 455.

Figure 34:
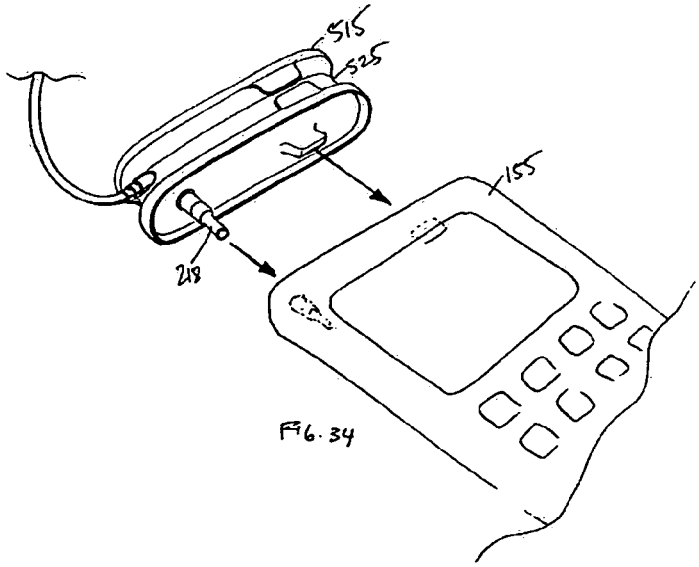
FIG. 34 shows a view of another embodiment of the invention: a combination electronic accessory plug, which is integrated into the body of the cable managing apparatus; also note an additional stabilizing prong mating with an unused port on the electronic device.
Figure 36:
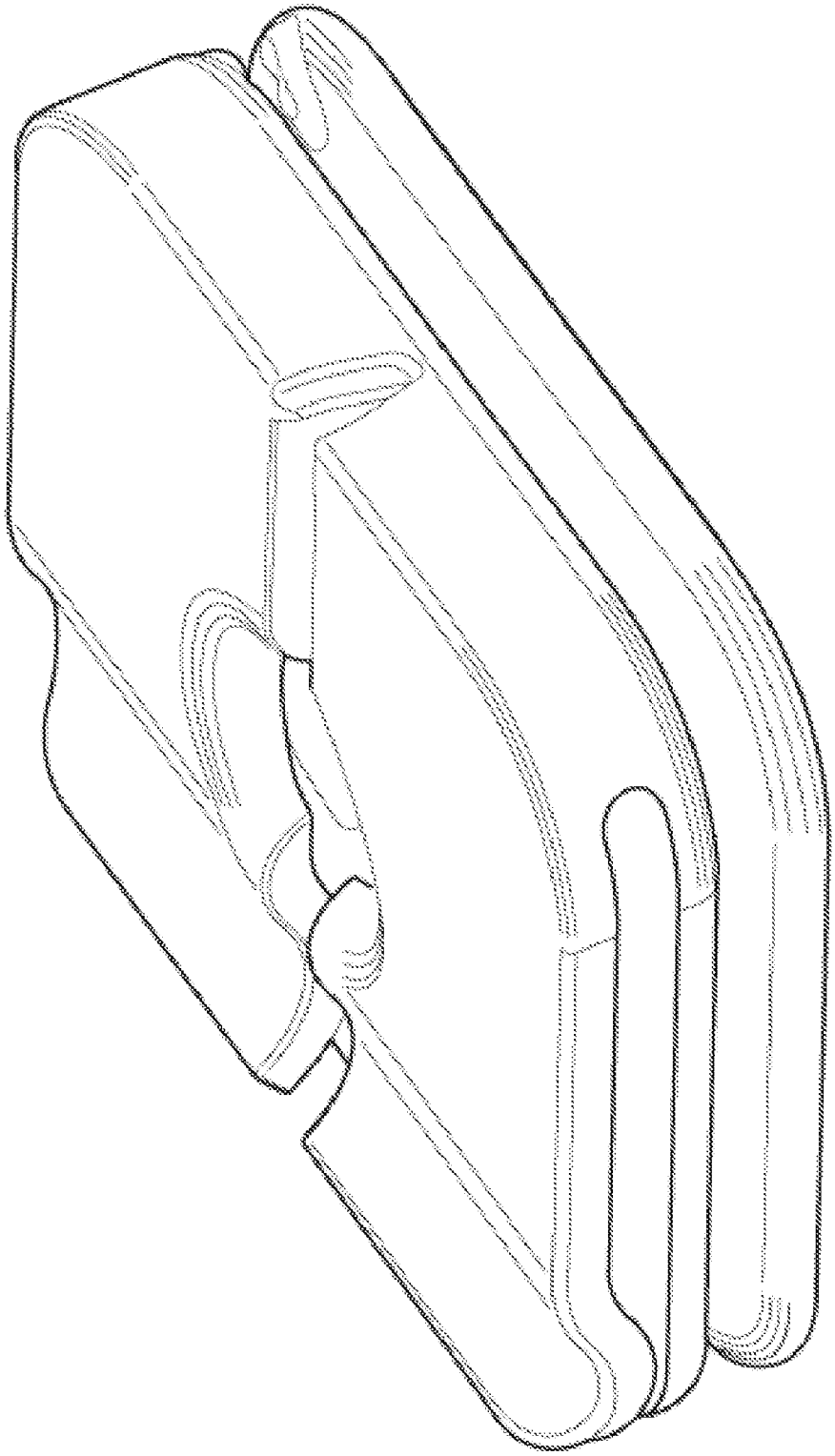
FIGS. 36 and 37 show front and rear views of another embodiment of the invention: a clip integrally molded to a planar flange.
Figure 37:
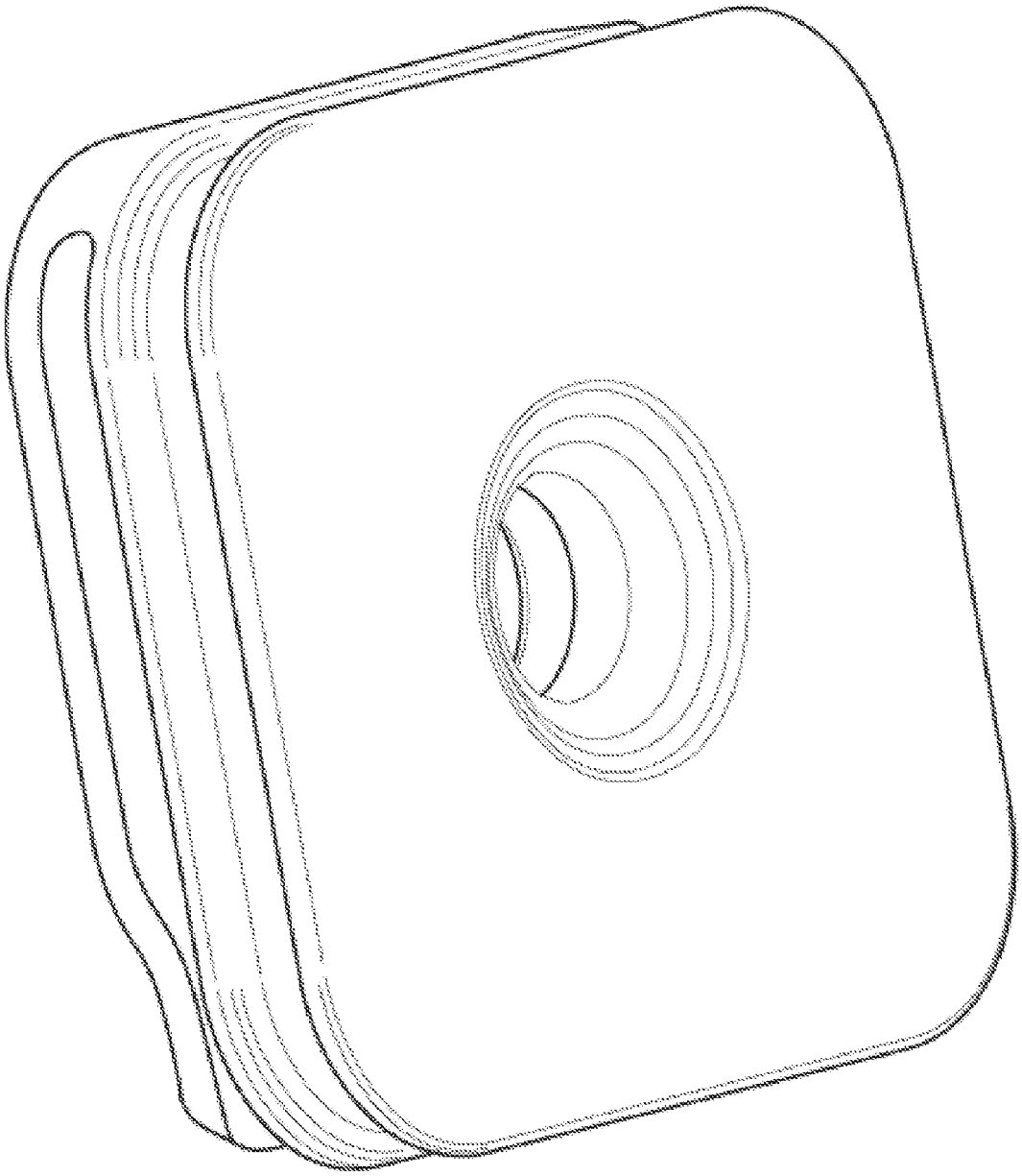
Figure 40:
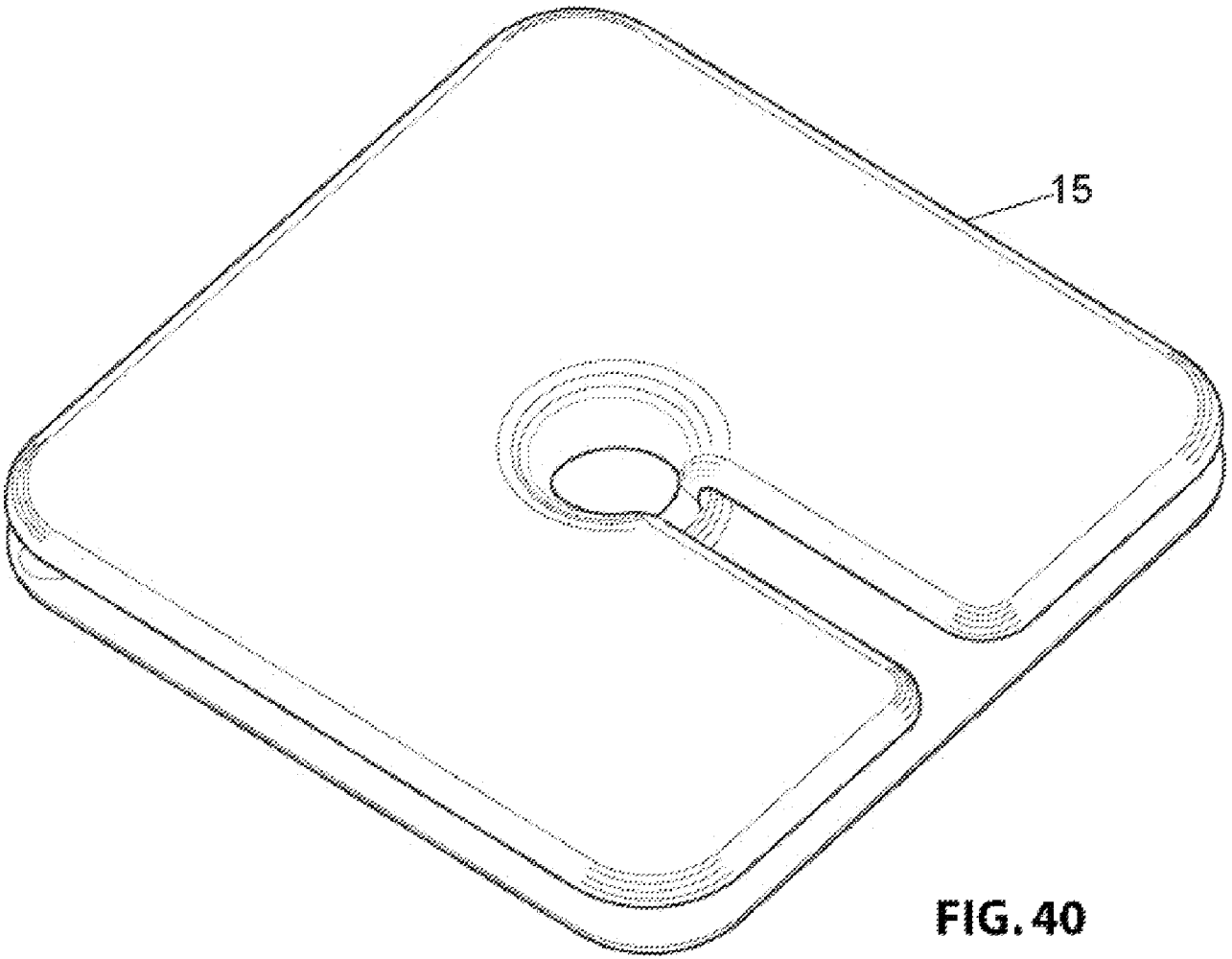
FIGS. 40, 41, and 42 show different views of the preferred embodiment of the invention.
Figure 41:
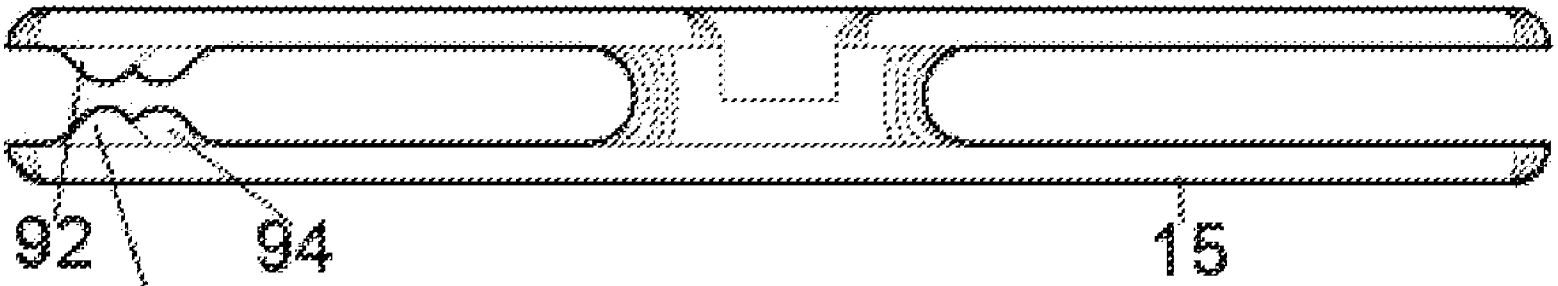
Figure 42:
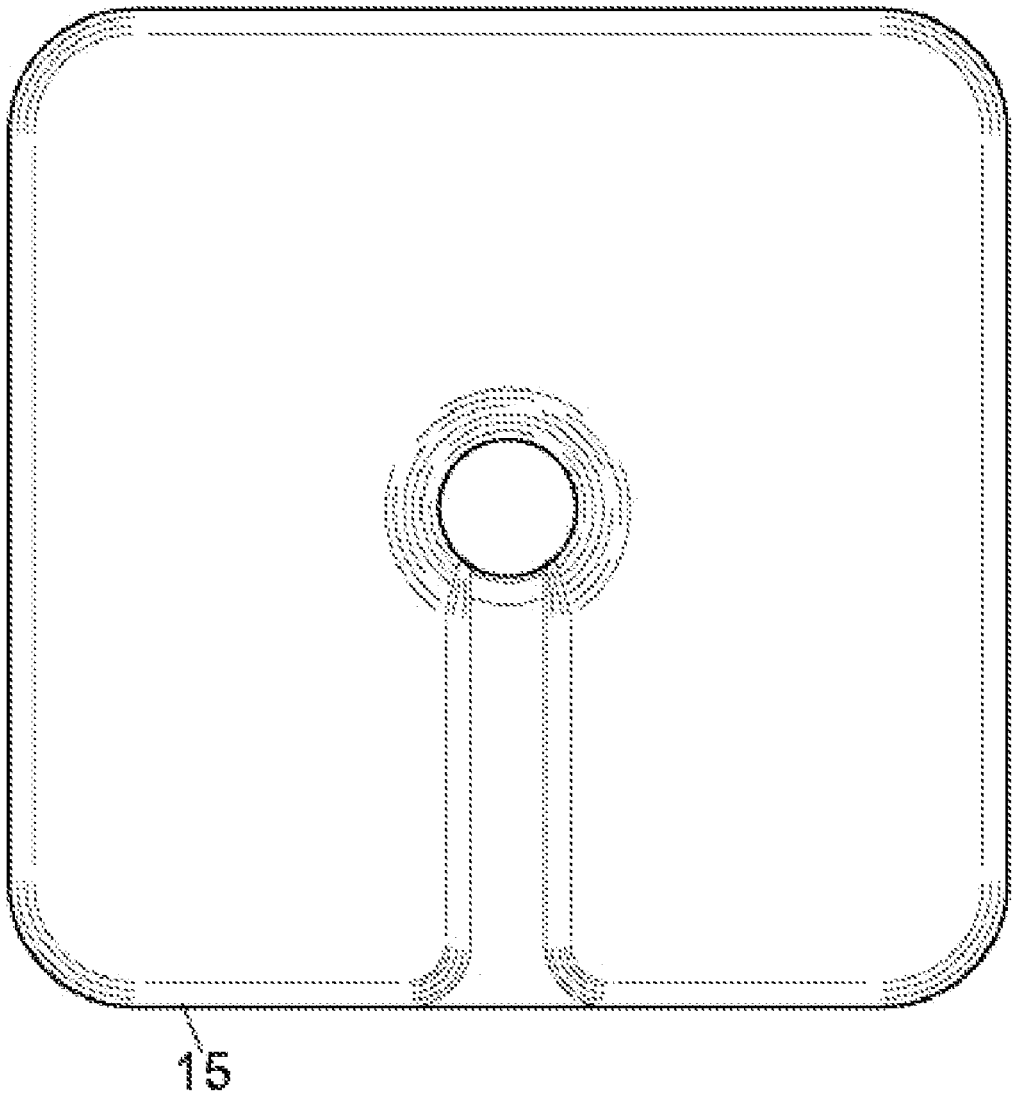

Integrated Headphone Apparatus:

In another embodiment of the invention, in FIG. 34, there is an integrated headphone apparatus 515 to accessorize a portable telephone, communicating device, pocket computer, or an MP3 or other digital audio/visual player. This apparatus 515 for managing cables and wires can be physically integrated with the headphone accessory; specifically, the headphone jack is fused, consolidated, blended, and merged with a cable management apparatus. The body or spool 525 would include the headphone output jack 218 so that when the user attaches the engagement end 450 of the apparatus to the electronic device, the user will also be connecting the headphone jack. One version of this apparatus is shown in FIG. 34, and similar engagement structures can be used for not only headphones, but also portable speakers, microphones, and other data/power cables.

When the headphones are not being used, the user simply wraps the cable or wires around the body of the apparatus. This invention can employ similar flanges, cable retainers, wire guides and notches as described in the previous embodiments. This integrated accessory and cable management device can also be applied for microphones and other power and data cables.

Figure 35:
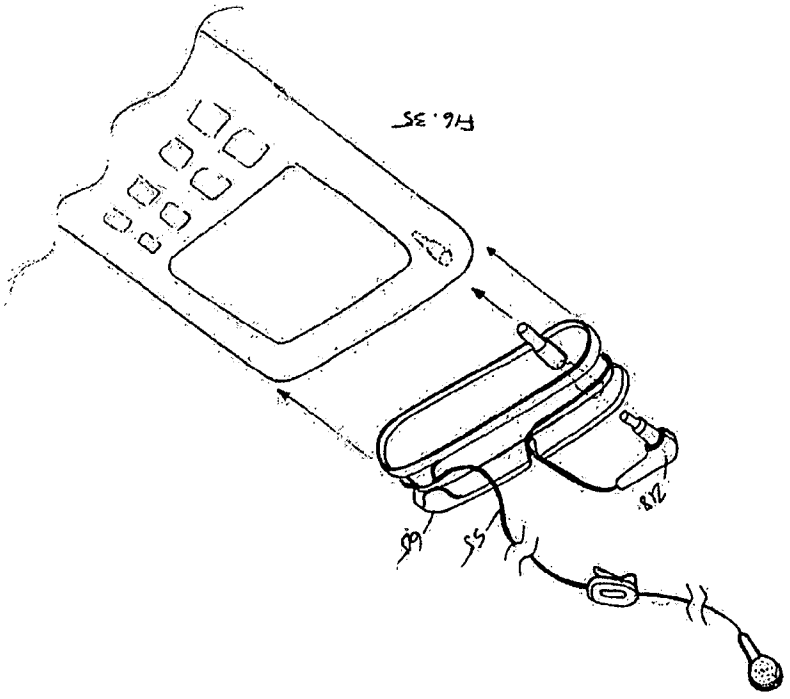
FIG. 35 shows a view of another embodiment of the invention: a cable management apparatus, which has a built-in output jack, which acts as a conduit for an electronic device accessory, such as headphones or speakers, which is integrated into the body of the cable managing apparatus.

FIG. 35 shows a view of another embodiment of the invention: a cable management apparatus 615, which has a built-in output jack, which acts as a conduit for an electronic device accessory, such as headphones or speakers. In this embodiment, this cable managing apparatus is not integrated with headphones or other electronic device accessories, but this embodiment is integrated into the body of the cable managing apparatus. This embodiment acts like a conduit or connection so that when the user plugs in the headphone or accessory jack to the apparatus 615, the apparatus connects this plug 218 with the electronic device's receptor 455 though a similar connection or mating end 618. Similarly, other jacks and ports can be mimicked and copied in this embodiment of the cable managing apparatus.

While the invention as described above in connection with preferred embodiments, it will be understood that it is not intended to limit the invention to those embodiments. On the contrary, it is intended to cover all alternatives, modifications, and equivalents as may be included within the spirit and scope of the invention as defined by the appended claims. Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

The invention claimed is:

1. An apparatus for managing a cable for a device with a surface, comprising:

a body having an axis and a center;

said body having a first end and a second end;

the first end having a first planar flange;

the first planar flange and the surface of the device are in a parallel orientation to one another and are oriented substantially perpendicular to the axis of the body;

the first planar flange and the surface of the device define a first cable retaining distance, which is oriented along the axis;

the first planar flange has substantially open and non-fused peripheral edges;

the first planar flange has at least one first planar flange surface, which has at least one first cable retainer near the peripheral edges of the first planar flange;

the at least one first cable retainer is oriented such that said at least one first cable retainer faces the surface of the device and defines a second cable retaining distance, which is along the axis of the body and is less than the first cable retaining distance;

the cable can be removably secured between the at least one first cable retainer and the surface of the device;

the second end of the body has a suction cup surface, which removably engages the surface of the device;

the at least one first cable retainer allows axial winding of the cable around the body and in a single winding plane and beyond the peripheral edges of the first planar flange, whereby the cable wrapped around the axis of the body in the single winding plane and in a substantially uniform manner, and held into place by the at least first cable retainer and the surface of the device.

2. The apparatus of claim 1 further having a hollow body center, and the surface of the device engages the apparatus through the hollow body center.

3. The apparatus of claim 1 wherein the first planar flange is square, rectangular, or irregular shaped.

4. The apparatus of claim 1 is comprised from plastic, alloy, metal, aluminum, or carbon fiber materials.

5. The apparatus of claim 1, wherein the first planar flange has at least one channel, which extends approximately from the center of the body to the peripheral edges of the first planar flange.

* * * * *